US010907601B2

(12) United States Patent
Matsuzawa et al.

(10) Patent No.: US 10,907,601 B2
(45) Date of Patent: Feb. 2, 2021

(54) FUEL INJECTION VALVE

(71) Applicant: Hitachi Automotive Systems, Ltd., Hitachinaka (JP)

(72) Inventors: Mitsuhiro Matsuzawa, Tokyo (JP); Kazuki Yoshimura, Tokyo (JP); Eiji Ishii, Tokyo (JP); Akihiro Yamazaki, Hitachinaka (JP); Takahiro Saito, Hitachinaka (JP); Nobuaki Kobayashi, Hitachinaka (JP)

(73) Assignee: Hitachi Automotive Systems, Ltd., Hitachinaka (JP)

( * ) Notice: Subject to any disclaimer, the term of this patent is extended or adjusted under 35 U.S.C. 154(b) by 89 days.

(21) Appl. No.: 16/303,419

(22) PCT Filed: Jan. 20, 2017

(86) PCT No.: PCT/JP2017/001992

§ 371 (c)(1),
(2) Date: Nov. 20, 2018

(87) PCT Pub. No.: WO2017/203745

PCT Pub. Date: Nov. 30, 2017

(65) Prior Publication Data

US 2019/0170102 A1 Jun. 6, 2019

(30) Foreign Application Priority Data

May 25, 2016 (JP) ..... 2016-104000

(51) Int. Cl.
*F02M 61/06* (2006.01)
*F02M 61/16* (2006.01)
(Continued)

(52) U.S. Cl.
CPC ..... *F02M 61/162* (2013.01); *F02M 51/06* (2013.01); *F02M 61/166* (2013.01);
(Continued)

(58) Field of Classification Search
CPC .... F02M 61/162; F02M 61/166; F02M 61/18; F02M 61/1806; F02M 61/1853;
(Continued)

(56) References Cited

U.S. PATENT DOCUMENTS

2003/0116650 A1 6/2003 Dantes et al.
2003/0141385 A1 7/2003 Xu
(Continued)

FOREIGN PATENT DOCUMENTS

EP 0 961 881 B1 6/2002
JP 2003-336562 A 11/2003
(Continued)

OTHER PUBLICATIONS

International Search Report (PCT/ISA/210) issued in PCT Application No. PCT/JP2017/001992 dated Feb. 21, 2017 with English translation (four (4) pages).
(Continued)

*Primary Examiner* — Qingzhang Zhou
*Assistant Examiner* — Joel Zhou
(74) *Attorney, Agent, or Firm* — Crowell & Moring LLP

(57) ABSTRACT

A fuel injection valve includes a valve seat, a valve element, and a plurality of swirl fuel injection passages. The plurality of swirl fuel injection passages are divided into a first swirl fuel injection passage group that forms a first spray and a second swirl fuel injection passage group that forms a second spray that is oriented in a direction different from a first direction.

7 Claims, 19 Drawing Sheets

(51) Int. Cl.
*F02M 51/06* (2006.01)
*F02M 61/18* (2006.01)

(52) U.S. Cl.
CPC ..... *F02M 61/18* (2013.01); *F02M 61/1806* (2013.01); *F02M 61/1853* (2013.01); *F02M 2200/9053* (2013.01)

(58) Field of Classification Search
CPC ..... F02M 61/1846; F02M 61/1826; F02M 61/1813; F02M 61/184; F02M 51/06; B05B 1/341; B05B 1/3415; B05B 1/3421; B05B 1/3426; B05B 1/3463; B05B 1/3468; B05B 1/3494
See application file for complete search history.

(56) References Cited

U.S. PATENT DOCUMENTS

2003/0234005 A1 12/2003 Sumisha et al.
2004/0217204 A1* 11/2004 Sugimoto ..... F02M 61/162 239/494
2010/0288857 A1* 11/2010 Hashii ..... F02M 61/163 239/585.1
2011/0163187 A1* 7/2011 Heyse ..... F02M 61/1853 239/533.12
2013/0175367 A1* 7/2013 Okamoto ..... F02M 61/162 239/463
2014/0158090 A1* 6/2014 Sumida ..... F02M 61/1853 123/445

FOREIGN PATENT DOCUMENTS

JP 2004-510915 A 4/2004
JP 2011-202513 A 10/2011
JP 2013-194725 A 9/2013
JP 2016-50552 A 4/2016
JP 2016-70070 A 5/2016
JP 2016070070 A * 5/2016

OTHER PUBLICATIONS

Japanese-language Written Opinion (PCT/ISA/237) issued in PCT Application No. PCT/JP2017/001992 dated Feb. 21, 2017 (five (5) pages).
Japanese-language Office Action issued in Japanese Application No. 2016-104000 dated Jun. 16, 2020 with English translation (five pages).
Hindi-language Office Action issued in Indian Application No. 201817042648 dated Sep. 23, 2020 with English translation (six (6) pages).

* cited by examiner

FUEL INJECTION VALVE

TECHNICAL FIELD

The present invention relates generally to fuel injection valves for use in internal combustion engines, such as gasoline engines, and more particularly, to a fuel injection valve including a valve element that abuts on a valve seat to thereby prevent leakage of fuel and that leaves the valve seat to thereby allow injection to be performed.

BACKGROUND ART

Automotive exhaust emissions control has become more and more stringent in these years. In line with the exhaust emissions control becoming more and more stringent, atomization and accurate injection direction are required of a spray from a fuel injection valve mounted in an automotive internal combustion engine. Spray atomization can achieve further reduction in fuel consumption for automotive engines. Injecting the spray at a target position can prevent the spray from sticking to a wall surface of, for example, an intake pipe. It is noted that the spray is very often used in a mode in which the spray is injected in a direction toward the intake valve set as a target position. Additionally, many known configurations include two intake valves provided for a single cylinder, in which case the spray injected from the fuel injection valve is composed of two sprays directed in directions toward the two intake valves (sprays directed in two directions).

JP-2003-336562-A (Patent Document 1), for example, discloses a fuel injection valve that can effectively promote atomization of fuel after the injection. The fuel injection valve disclosed in Patent Document 1 includes a lateral passage (referred to in the present invention as a swirl chamber introduction passage) and a swirl chamber (so referred to in the present invention) formed between a valve seat member and an injector plate that is joined to a front end face of the valve seat member. The lateral passage communicates with a downstream side of the valve seat. The lateral passage has a downstream end opening tangentially to the swirl chamber. The fuel injection valve further has a fuel orifice (hereinafter referred to as an orifice) drilled in the injector plate. The orifice injects fuel to which swirl is imparted in the swirl chamber. The orifice is disposed at a position a predetermined distance offset toward an upstream end side of the lateral passage from a center of the swirl chamber (see the Abstract).

JP-2011-202513-A (Patent Document 2), for example, discloses a fuel injection valve that can promote atomization of injected fuel through reduction in fluid loss of fuel. The fuel injection valve disclosed in Patent Document 2 includes a valve seat, a valve element, an orifice plate, and a cover plate. The valve seat is disposed at a distal end portion of a valve main unit and has a valve seat surface. The valve element leaves and abuts on a seat portion of the valve seat surface to thereby open or close a fuel passage. The orifice plate is disposed at the distal end portion of the valve main unit on a side downstream of the valve seat. The orifice plate has a plurality of orifices through which fuel is injected to an outside. The cover plate is disposed inside the valve seat on a side upstream of the orifice plate to thereby form a radial passage across the orifice plate. The cover plate further includes a covering portion that covers orifices so as not to allow a fuel flow from the seat portion to flow linearly into the orifices. An extension of the valve seat surface thereby does not cross an upper surface of the cover plate (see the Abstract). In addition, in the fuel injection valve disclosed in Patent Document 2, the orifice plate has four orifices disposed therein. The four orifices are oriented downstream toward the outside with respect to a central axis of the fuel injection valve. The four orifices are divided into orifice groups directed in two directions toward intake valves of the internal combustion engine. The orifice plate has grooves formed in an upper surface thereof. The grooves are each divided into a swirl chamber and an elongated approach passage. The swirl chamber surrounds each orifice to have in part a circularly arcuate shape. The approach passage connects with the swirl chamber. The swirl chamber has an inner surface connected tangentially with a side surface on one side of the approach passage. The swirl chamber has a circularly arcuate shape extending about 270° about the orifice excepting an opening in the approach passage (see paragraphs 0065 and 0066).

PRIOR ART DOCUMENT

Patent Document

Patent Document 1: JP-2003-336562-A
Patent Document 2: JP-2011-202513-A

SUMMARY OF THE INVENTION

Problem to be Solved by the Invention

The technique disclosed in Patent Document 1 is directed particularly toward increasing a swirling force of fuel by increasing a swirling velocity of the fuel in order to promote atomization of the fuel. Meanwhile, the entire inlet opening surface of the orifice resides in a region out of a region extended from the swirl chamber introduction passage and the orifice has a center spaced widely apart from a centerline of the swirl chamber introduction passage. This results in the fuel injection valve disclosed in Patent Document 1 having a configuration in which a great swirling force acts on fuel that flows into the swirl chamber. In this case, the strong swirling force, while achieving an effect of promoting atomization of the fuel injected from the orifice, unfortunately causes a spray to spread widely in a region immediately below the orifice. When the spray spreads widely in the region immediately below the orifice in a configuration having a plurality of orifices formed in a single nozzle plate, the spray injected from each orifice overlaps each other, so that formation of sprays in a plurality of directions from the single nozzle plate is a difficult task to achieve.

The technique disclosed in Patent Document 2 is directed particularly toward reduction in the fluid loss in order to promote atomization. No consideration is, however, given to prevention of the spray from spreading in the fuel injection valve disclosed in Patent Document 2 and disposition of the approach passage, the swirl chamber, and the orifices are not thoroughly considered for the promotion of atomization of fuel while preventing the spray from spreading.

In the fuel injection valves disclosed in Patent Documents 1 and 2, the swirling force is imparted to the fuel in the swirl chamber and the fuel injected from the orifice is swirled so as to form a thin film. The thin film is then broken down, which promotes atomization of the spray. In this case, the imparting of the large swirling force to the fuel forms the thin film, thereby allowing atomization of the spray to be promoted. This, however, results in a widely spreading spray. Specifically, such fuel injection valves involve degraded atomization performance when the swirling force to be imparted to the fuel is reduced to minimize the spread of the spray.

An object of the present invention is to provide a fuel injection valve that can achieve sufficient atomization, while preventing a spray from spreading.

Means for Solving the Problem

To solve the foregoing problem, an aspect of the present invention provides a fuel injection valve. The fuel injection valve includes: a valve seat; a valve element that cooperates with the valve seat to open or close a fuel passage; and a plurality of swirl fuel injection passages, disposed downstream side of the valve seat, for imparting a swirling force to fuel to thereby inject the fuel outside. Each of the swirl fuel injection passages includes: a swirl chamber that imparts a swirling force to fuel; a swirl chamber introduction passage that introduces fuel to the swirl chamber; and an orifice, disposed in the swirl chamber, for injecting fuel outside. When a rectangular coordinate system is imagined on an imaginary plane that extends perpendicularly to a central axis of the fuel injection valve and onto which the swirl fuel injection passage is projected, the rectangular coordinate system having a center of an inlet opening surface of the orifice as an origin and having an X-axis extending in parallel with a centerline of the swirl chamber introduction passage and being positive in a direction from an upstream side toward a downstream side of the swirl chamber introduction passage and a Y-axis extending perpendicularly to the X-axis and being positive in a direction away from the centerline, and when the positive direction of the X-axis is defined as 0° and an angular direction of rotation from an angular position of 0° toward the centerline of the swirl chamber introduction passage is defined as a positive angular direction, the orifice has an inclination direction set to fall within a range from 0° to 180°, both exclusive, the inclination direction being defined by a projection straight line representing a straight line that extends from the center of the inlet opening surface toward a center of an outlet opening surface of the orifice and that is projected onto the imaginary plane, and a part of the inlet opening surface of the orifice is formed in the swirl chamber introduction passage.

Effect of the Invention

In accordance with the aspect of the present invention, a strength of the swirling force is adjusted through the disposition of the orifice, to thereby prevent the spray from spreading, and a collision force of fuel on an inner wall surface of the orifice is increased through the setting of the inclination direction of the orifice, to thereby prevent atomization performance from being degraded or allow atomization performance to be improved. Sufficient atomization can be achieved while the spray is prevented from spreading.

Problems, configurations, and effects of the present invention other than those described above will become apparent through the following description of embodiments.

MODES FOR CARRYING OUT THE INVENTION

Figure 1:
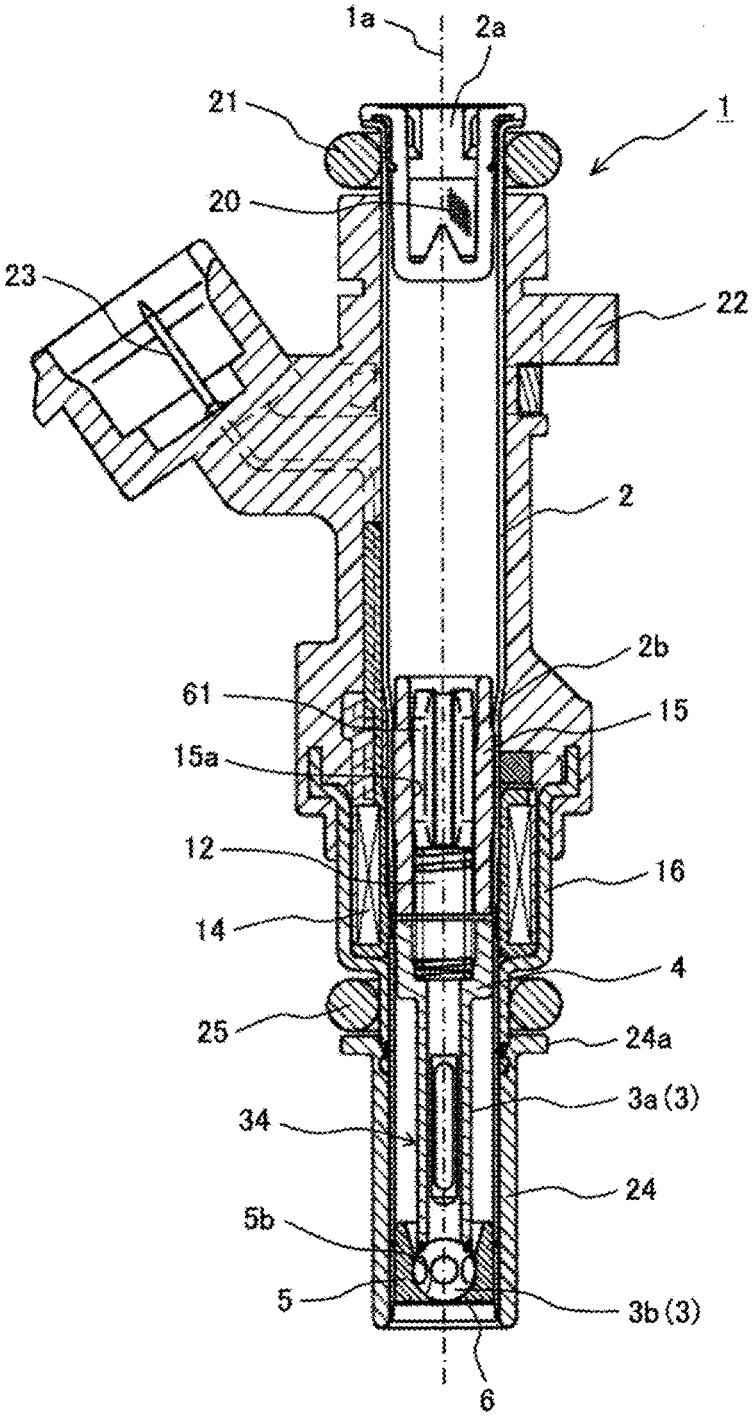
FIG. 1 is a cross-sectional view of a fuel injection valve 1 according to an embodiment of the present invention.

Embodiments of the present invention will be described below with reference to the accompanying drawings. In each of the different embodiments, like or corresponding parts are identified by the same reference numerals and descriptions for those parts will be omitted.

First Embodiment

A first embodiment of the present invention will be described below with reference to FIGS. 1 to 11.

FIG. 1 is a cross-sectional view of a fuel injection valve 1 according to an embodiment of the present invention. The fuel injection valve 1 shown in FIG. 1 shares an identical configuration with second to fifth embodiments to be described later.

Reference is made to FIG. 1. The fuel injection valve 1 supplies an internal combustion engine used, for example, as an automotive engine with fuel. A casing 2 is formed by pressworking or cutting, for example, into a cylindrical shape including a slender, thin-wall portion. The casing 2 has a shape including a shoulder 2*b* in the middle from both ends. The casing 2 is formed into a cylindrical shape constituting an integrated structure extending substantially from a proximal end to a distal end of the fuel injection valve 1. The casing 2 is formed of a ferrite-based stainless steel to which a flexible material, such as titanium, is added, forming a magnetic substance (magnetic material) that is magnetized by application of a magnetic field.

A fuel supply port 2*a* is disposed in a first end face (upper end face) of the casing 2. A nozzle plate 6 is disposed at a second end face (lower end face) of the casing 2. The nozzle plate 6 is fixedly attached to a nozzle body 5.

The nozzle plate 6 has a plurality of holes 13 (see FIG. 2) through which fuel is injected. The holes 13 may be referred to as orifices or fuel injection holes and will hereinafter be referred to as the orifices.

An electromagnetic coil 14 and a magnetic yoke 16 that embraces the electromagnetic coil 14 are disposed on the outside of the casing 2 shown in FIG. 1. A fixed core 15, an anchor 4, a valve element 3, the nozzle body 5, and the nozzle plate 6 are disposed inside the casing 2.

The fixed core 15 is first inserted inside the casing 2 and is then disposed inside the electromagnetic coil 14.

The anchor 4 faces an end face on a distal end side of the fixed core 15 having a void interposed therebetween. The anchor 4 is assembled so as to be capable of being displaced in an axial direction (direction along a central axis 1*a*) with the valve element 3 to be described later. The anchor 4 is formed through injection molding of metal particles formed of a magnetic material using, for example, metal injection molding (MIM).

The valve element 3 is formed integrally with the anchor 4. The valve element 3 includes a hollow rod portion 3*a* and a ball valve portion 3*b*. The rod portion 3*a* extends in the direction of the central axis 1*a*. The ball valve portion 3*b* is fixedly attached to a distal end of the rod portion 3*a*. The valve element 3 may be configured as an independent member separate from the anchor 4. The valve element 3 and the anchor 4 constitute a movable member 34 that is configured so as to be capable of being displaced in the direction extending along the central axis 1*a*.

The nozzle body 5 is disposed on a distal end side of the valve element 3 and on a proximal end side with respect to the nozzle plate 6. The nozzle body 5 is inserted in a distal end portion of the casing 2 and fixed to the casing 2 by welding. Additionally, the nozzle body 5 has a valve seat surface 5*b* formed therein. The valve element 3 has a distal end (ball valve portion 3*b*) thereof seated on the valve seat surface 5*b*. The term "distal end side," as used herein, refers to a side adjacent to a distal end portion (on the side on which fuel is injected) of the fuel injection valve 1 and the term "proximal end side," as used herein, refers to the a side adjacent to a proximal end portion (on a side on which the fuel supply port 2*a* is disposed) of the fuel injection valve 1.

A portion on which the valve seat surface 5*b* and the ball valve portion 3*b* abut on each other constitutes a seat portion. The ball valve portion 3*b* abutting on the valve seat surface 5*b* closes a fuel passage and the ball valve portion 3*b* leaving the valve seat surface 5*b* opens the fuel passage. Specifically, the valve element 3 cooperates with the valve seat surface (valve seat) 5*b* to open or close the fuel passage at the seat portion. It is noted that the seat portion of the valve seat surface 5*b* may be referred to as a valve seat. The present embodiment does not require that the valve seat surface 5*b* be differentiated from the seat portion and the valve seat may be either the valve seat surface 5*b* or the seat portion.

The nozzle plate 6 is disposed on an end face on the distal end side of the nozzle body 5. The nozzle plate 6 has the orifices 13 formed to pass therethrough in a thickness direction. Thus, the nozzle plate 6 may be referred to also as an orifice plate. The orifices 13 are disposed downstream side of the valve seat surface 5*b*. Fuel that has flowed past the fuel passage at the seat portion is injected to the outside through the orifices 13. The nozzle plate 6 has a face in contact with the nozzle body 5 joined through welding.

In FIG. 1, a spring 12 as an elastic member is disposed inside a pass-through hole 15*a*. The pass-through hole 15*a* passes through a central portion of the fixed core 15. The spring 12 imparts a pressing force (urging force) to press a distal end (seat portion) of the valve portion 3*b* of the valve element 3 up against the seat portion of the valve seat surface 5*b* of the nozzle body 5. A spring adjuster 61 is disposed, without interruption from the spring 12, on the side of the spring 12 adjacent to the fuel supply port 2*a* (opposite to the anchor 4). The spring adjuster 61 adjusts the pressing force of the spring 12.

A filter 20 is disposed at the fuel supply port 2*a*. The filter 20 removes foreign matter from the fuel. In addition, an O-ring 21 is mounted on an outer periphery of the fuel supply port 2*a*. The O-ring 21 seals the fuel to be supplied. A resin cover 22 is disposed near the fuel supply port 2*a*. The resin cover 22 is disposed so as to cover the casing 2 and the yoke 16 by, for example, plastic molding. A connector 23 is integrally molded with the resin cover 22. The connector 23 supplies the electromagnetic coil 14 with electric power.

A protector 24 is disposed at the distal end portion of the fuel injection valve 1 to thereby cover an outer peripheral surface on the distal end side of the casing 2. The protector 24 is a tube-shaped member formed of, for example, a resin material. The protector 2 has a flange portion 24*a* formed on an upper end portion thereof. The flange portion 24*a* protrudes outwardly in a radial direction from the outer peripheral surface of the casing 2. Additionally, an O-ring 25 is mounted on an outer periphery on the distal end side of the casing 2. The O-ring 25 is disposed in a locked state between the yoke 16 and the flange portion 24*a* of the protector 24. When, for example, the casing 2 (fuel injection valve 1) has the distal end side mounted at a mounting portion (not shown) provided for an intake pipe of the internal combustion engine, the O-ring 25 seals a part between the fuel injection valve 1 and the mounting portion.

In the fuel injection valve 1 configured as described above, when the electromagnetic coil 14 is in a de-energized state, the distal end of the valve element 3 is brought into tight contact with the nozzle body 5 as a result of the pressing force of the spring 12. No gap to serve as a fuel passage is formed between the valve element 3 and the nozzle body 5 under the foregoing condition and thus fuel that has flowed from the fuel supply port 2*a* stays inside the casing 2.

When current as an injection pulse is applied to the electromagnetic coil 14, a magnetic flux is generated in a magnetic circuit that is composed of the yoke 16 formed of a magnetic material, the fixed core 15, and the anchor 4. An electromagnetic force of the electromagnetic coil 14 causes the anchor 4 to move to be in contact with a lower end surface of the fixed core 15. When the valve element 3 moves with the anchor 4 toward the fixed core 15 side, a gap to serve as the fuel passage is formed between the valve portion 3*b* of the valve element 3 and the valve seat surface 5*b* of the nozzle body 5. The fuel inside the casing 2 flows in through an area around the valve portion 3*b* before being injected from the orifices 13 (see FIG. 2).

A fuel injection amount is varied as follows. Specifically, the valve element 3 (valve portion 3*b*) is moved in the axial direction in response to the injection pulse applied intermittently to the electromagnetic coil 14, so that timing at which a valve open state is changed to a valve closed state, or vice versa, is varied.

Figure 2:
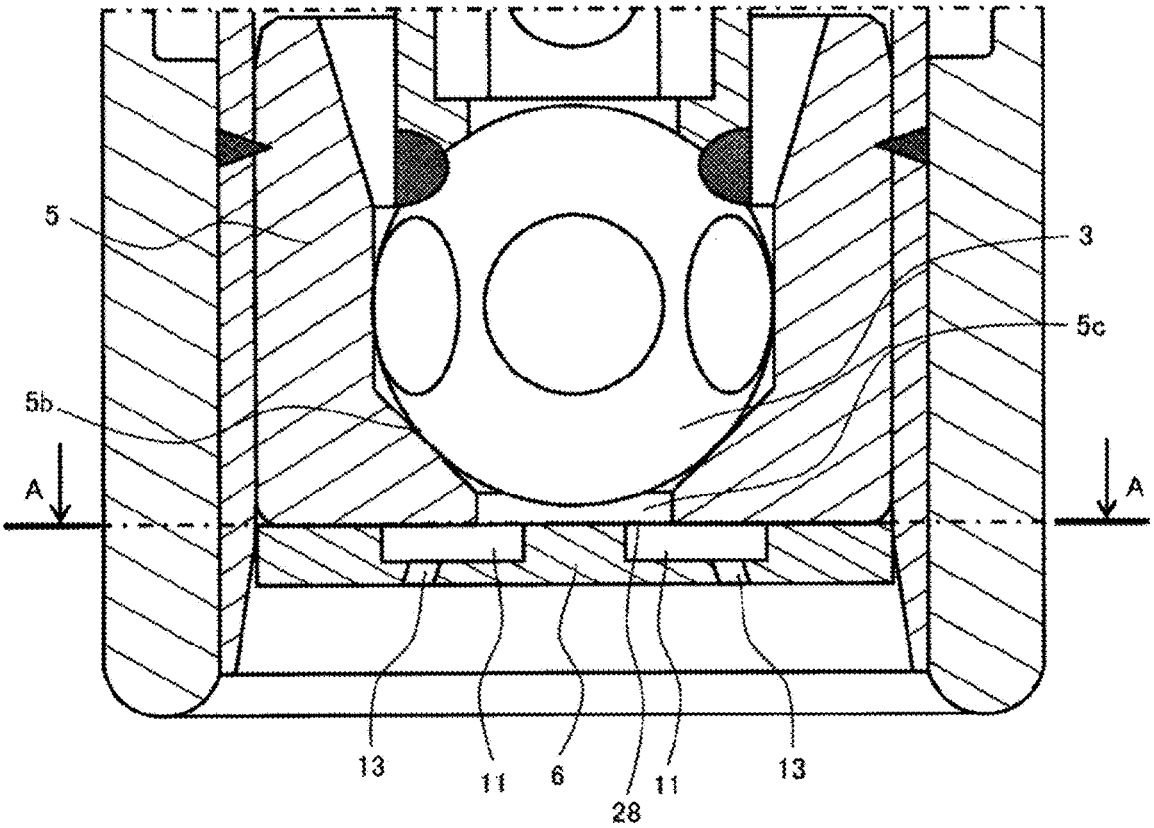
FIG. 2 is an enlarged, cross-sectional view of an area near a distal end of a valve element 3 in the fuel injection valve 1 according to the first embodiment of the present invention.

FIG. 2 is an enlarged, cross-sectional view of the area near the distal end of the valve element 3 in the fuel injection valve 1 according to the first embodiment of the present invention. Major components relating to the present invention will be briefly described with reference to FIG. 2.

As shown in FIG. 2, a ball valve is used for the valve portion 3*b* of the valve element 3. A steel ball for ball bearings complying with the JIS standards, for example, is used for the ball 3*b*. Considerations given in selecting the ball include: suitability for the enhanced seating performance because of a high level of circularity the ball offers and mirror finish applied thereto; and reduced manufacturing cost achieved by mass production. For a configuration as a valve element, the ball is required to have a diameter of about 3 to 4 mm. This represents a need for a reduced weight because of functioning involved as a movable valve.

In the nozzle body 5, an inclined surface (valve seat surface 5*b*) including a seat position that is in tight contact with the valve element 3 forms a shape of a side surface portion of a truncated cone having an angle of about 90° (80 to 100°). Specifically, an angle formed between the valve seat surface 5*b* and the central axis 1*a* is about 45° (40 to 50°). This angle of the inclined surface is an optimum angle (at which a grinding machine can be operated under a best possible condition) for grinding an area near the seat position and enhancing circularity in a circumferential direction of the valve seat surface 5*b*. The angle can maintain an extremely high level of the above-described seating performance with respect to the valve element 3. The nozzle body 5 has hardness enhanced by quenching and unnecessary magnetism has been removed from the nozzle body 5 through demagnetization. The foregoing configurations of the valve element enable control of the injection amount free of fuel leakage. A valve element structure offering favorable cost performance can also be provided.

When the fuel injection valve 1 is in the valve closed state, the valve element 3 abuts on the valve seat surface 5*b* constituting a conical surface and sealing of fuel is maintained. At this time, a contact portion on the valve element 3 side forms a spherical surface and the contact between the valve seat surface having a conical surface shape (truncated conical shape) and the spherical surface is substantially in a line contact state.

When the valve element 3 rises with a resultant gap between the valve element 3 and the nozzle body 5, fuel flows through the gap and, by way of an opening 5*c* in the nozzle body 5, passes through a fuel introduction port 28. The fuel then flows into each of swirl chamber introduction passages 11 before being injected from the orifices 13 to the outside.

Figure 3:
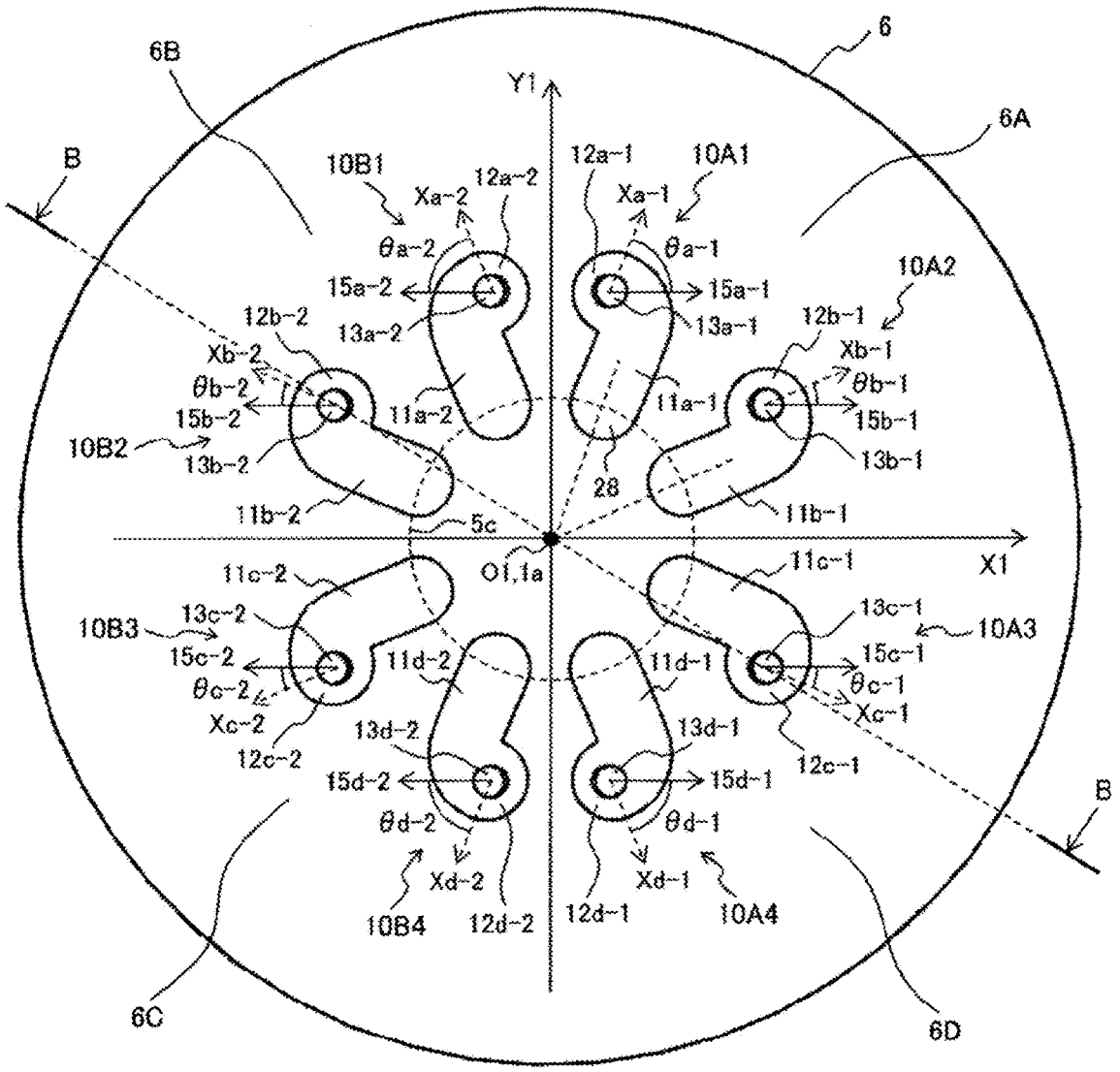
FIG. 3 shows a nozzle plate 6 in the fuel injection valve 1 according to the first embodiment of the present invention, as viewed from a valve element side (proximal end side) (cross-sectional view taken along line A-A in FIG. 2).

A configuration of the nozzle plate 6 will be described below with reference to FIG. 3. FIG. 3 shows the nozzle plate 6 in the fuel injection valve 1 according to the first embodiment of the present invention, as viewed from the valve element side (proximal end side) (cross-sectional view taken along line A-A in FIG. 2). It is noted that the cross section of the nozzle plate 6 shown in FIG. 2 is taken along a straight line B-B in FIG. 3.

In FIG. 3, let an X1-axis be an axis that passes through a center O1 of the nozzle plate 6 and extends in a lateral direction in a drawing plane of FIG. 3 and let a Y1-axis be an axis that passes through the center O1 of the nozzle plate 6 and extends in a vertical direction in the drawing plane of FIG. 3 perpendicularly to the X1-axis. The X1-axis and the Y1-axis have the center O1 as an origin and cross each other at the center O1. Specifically, the Y1-axis is a straight line that represents a first plane that includes the central axis 1*a* and that is projected onto a virtual plane perpendicular to the central axis 1*a* and the X1-axis is a straight line that represents a second plane that is orthogonal to the first plane and that is projected onto the virtual plane perpendicular to the central axis 1*a*.

The nozzle plate 6 has: swirl chamber introduction passages 11*a*-1, 11*a*-2, 11*b*-1, 11*b*-2, 11*c*-1, 11*c*-2, 11*d*-1, and 11*d*-2; swirl chambers 12*a*-1, 12*a*-2, 12*b*-1, 12*b*-2, 12*c*-1, 12*c*-2, 12*d*-1, and 12*d*-2; and orifices 13*a*-1, 13*a*-2, 13*b*-1, 13*a*-2, 13*c*-1, 13*c*-2, 13*d*-1, and 13*d*-2. The swirl chamber introduction passages 11*a*-1, 11*a*-2, 11*b*-1, 11*b*-2, 11*c*-1, 11*c*-2, 11*d*-1, and 11*d*-2 each extend from a central portion of the nozzle plate 6 toward the outside in the radial direction. The swirl chambers 12*a*-1, 12*a*-2, 12*b*-1, 12*b*-2, 12*c*-*i*, 12*c*-2, 12*d*-*l*, and 12*d*-2 for imparting swirl to fuel are disposed downstream side of the respective swirl chamber introduction passages. The orifices 13*a*-*l*, 13*a*-2, 13*b*-*l*, 13*a*-2, 13*c*-*i*, 13*c*-2, 13*d*-*l*, and 13*d*-2 each inject fuel to the outside. The orifices 13*a*-*l*, 13*a*-2, 13*b*-1, 13*a*-2, 13*c*-*i*, 13*c*-2, 13*d*-*l*, and 13*d*-2 are formed in the respective swirl chambers 12*a*-*l*, 12*a*-2, 12*b*-*l*, 12*b*-2, 12*c*-1, 12*c*-2, 12*d*-*l*, and 12*d*-2.

The swirl chamber introduction passage 11*a*-1, the swirl chamber 12*a*-1, and the orifice 13*a*-1 constitute a swirl fuel injection passage 10A1 that imparts a swirling force to fuel to thereby inject the fuel outside the fuel injection valve 1. The swirl chamber introduction passage 11*b*-1, the swirl chamber 12*b*-1, and the orifice 13*b*-1 constitute a swirl fuel injection passage 10A2 that imparts a swirling force to fuel to thereby inject the fuel outside the fuel injection valve 1. The swirl chamber introduction passage 11*c*-1, the swirl chamber 12*c*-1, and the orifice 13*c*-1 constitute a swirl fuel injection passage 10A3 that imparts a swirling force to fuel to thereby inject the fuel outside the fuel injection valve 1. The swirl chamber introduction passage 11*d*-1, the swirl chamber 12*d*-1, and the orifice 13*d*-1 constitute a swirl fuel injection passage 10A4 that imparts a swirling force to fuel to thereby inject the fuel outside the fuel injection valve 1.

Fuel streams injected from the swirl fuel injection passages 10A1 to 10A4 form a single spray (spray group) oriented toward an identical direction (positive direction of the X1-axis).

The swirl chamber introduction passage 11*a*-2, the swirl chamber 12*a*-2, and the orifice 13*a*-2 constitute a swirl fuel injection passage 10B1 that imparts a swirling force to fuel to thereby inject the fuel outside the fuel injection valve 1. The swirl chamber introduction passage 11*b*-2, the swirl chamber 12*b*-2, and the orifice 13*b*-2 constitute a swirl fuel injection passage 10B2 that imparts a swirling force to fuel to thereby inject the fuel outside the fuel injection valve 1. The swirl chamber introduction passage 11*c*-2, the swirl chamber 12*c*-2, and the orifice 13*c*-2 constitute a swirl fuel injection passage 10B3 that imparts a swirling force to fuel to thereby inject the fuel outside the fuel injection valve 1. The swirl chamber introduction passage 11*d*-2, the swirl chamber 12*d*-2, and the orifice 13*d*-2 constitute a swirl fuel injection passage 10B4 that imparts a swirling force to fuel to thereby inject the fuel outside the fuel injection valve 1.

Fuel streams injected from the swirl fuel injection passages 10B1 to 10B4 form a single spray (spray group) oriented toward an identical direction (negative direction of the X1-axis).

In the present embodiment, the swirl fuel injection passages 10A1 and 10A2 including the orifices 13*a*-1 and 13*b*-1 are disposed in the first quadrant, the swirl fuel injection passages 10B1 and 10B2 including the orifices 13*a*-2 and 13*b*-2 are disposed in the second quadrant, the swirl fuel injection passages 10B3 and 10B4 including the orifices 13*c*-2 and 13*d*-2 are disposed in the third quadrant, and the swirl fuel injection passages 10A3 and 10A4 including the orifices 13*c*-1 and 13*d*-1 are disposed in the fourth quadrant.

In the following description, the swirl chamber introduction passages 11*a*-1, 11*a*-2, 11*b*-1, 11*b*-2, 11*c*-1, 11*c*-2, 11*d*-1, and 11*d*-2, when one does not need to be differentiated from others, will be referred to simply as the swirl chamber introduction passage 11. Similarly, the swirl fuel injection passages, the swirl chambers, and the orifices will be referred to simply as the swirl fuel injection passage 10, the swirl chamber 12, and the orifice 13, respectively, when the swirl fuel injection passages, the swirl chambers, and the orifices each do not need to be differentiated among the respective groups (see FIG. 4).

In the present embodiment, the swirl fuel injection passage 10A1 and the swirl fuel injection passage 10A4 are formed to be symmetrical with respect to a plane that extends in parallel with, and passes through, the X1-axis (plane including the X1-axis) and that extends in parallel with, and passes through, the central axis 1*a* and that is perpendicular to the drawing plane (plane including the X1-axis and the central axis 1*a*). The swirl fuel injection passage 10A2 and the swirl fuel injection passage 10A3 are formed to be symmetrical with respect to the plane that extends in parallel with, and passes through, the X1-axis (plane including the X1-axis) and that extends in parallel with, and passes through, the central axis 1*a* and that is perpendicular to the drawing plane (plane including the X1-axis and the central axis 1*a*). The swirl fuel injection passage 10B1 and the swirl fuel injection passage 10B4 are formed to be symmetrical with respect to the plane that extends in parallel with, and passes through, the X1-axis (plane including the X1-axis) and that extends in parallel with, and passes through, the central axis 1*a* and that is perpendicular to the drawing plane (plane including the X1-axis and the central axis 1*a*). The swirl fuel injection passage 10B2 and the swirl fuel injection passage 10B3 are formed to be symmetrical with respect to the plane that extends in parallel with, and passes through, the X1-axis (plane including the X1-axis) and that extends in parallel with, and passes through, the central axis 1*a* and that is perpendicular to the drawing plane (plane including the X1-axis and the central axis 1*a*).

Additionally, in the embodiment, the swirl fuel injection passage 10A1 and the swirl fuel injection passage 10B1 are formed to be symmetrical with respect to a plane that extends in parallel with, and passes through, the Y1-axis (plane including the Y1-axis) and that extends in parallel with, and passes through, the central axis 1*a* and that is perpendicular to the drawing plane (plane including the Y1-axis and the central axis 1*a*). The swirl fuel injection passage 10A2 and the swirl fuel injection passage 10B2 are formed to be symmetrical with respect to the plane that extends in parallel with, and passes through, the Y1-axis (plane including the Y1-axis) and that extends in parallel with, and passes through, the central axis 1*a* and that is perpendicular to the drawing plane (plane including the Y1-axis and the central axis 1*a*). The swirl fuel injection passage 10A3 and the swirl fuel injection passage 10B3 are formed to be symmetrical with respect to the plane that extends in parallel with, and passes through, the Y1-axis (plane including the Y1-axis) and that extends in parallel with, and passes through, the central axis 1*a* and that is perpendicular to the drawing plane (plane including the Y1-axis and the central axis 1*a*). The swirl fuel injection passage 10A4 and the swirl fuel injection passage 10B4 are formed to be symmetrical with respect to the plane that extends in parallel with, and passes through, the Y1-axis (plane including the Y1-axis) and that extends in parallel with, and passes through, the central axis 1*a* and that is perpendicular to the drawing plane (plane including the Y1-axis and the central axis 1*a*).

An orifice group composed of the orifices 13*a*-1, 13*b*-1, 13*c*-1, and 13*d*-1 is denoted as a first orifice group. An orifice group composed of the orifices 13*a*-2, 13*b*-2, 13*c*-2, and 13*d*-2 is denoted as a second orifice group. The orifices 13*a*-1, 13*b*-1, 13*c*-1, and 13*d*-1 of the first orifice group generally inject fuel in one direction to thereby form a first fuel spray. The orifices 13*a*-2, 13*b*-2, 13*c*-2, and 13*d*-2 of the second orifice group 13B generally inject fuel in another direction different from the direction in which the first orifice group generally injects fuel to thereby form a second fuel spray.

The present embodiment is configured such that, as described above, the swirl fuel injection passages 10A1 to 10A4 are symmetrical to the swirl fuel injection passages 10B1 to 10B4 with respect to the plane including the Y1-axis and the central axis 1*a*. Thus, the first fuel spray and the second fuel spray are formed to be symmetrical with respect to the plane including the Y1-axis and the central axis 1*a*. To form the first fuel spray and the second fuel spray asymmetrically with respect to the plane including the Y1-axis and the central axis 1*a*, the swirl fuel injection passages 10A1 to 10A4 may be formed to be asymmetrical to the swirl fuel injection passages 10B1 to 10B4 with respect to the plane including the Y1-axis and the central axis 1*a*. In this case, the swirl fuel injection passages 10A1, 10A2, 10B1, and 10B2 may be formed to be asymmetrical to the swirl fuel injection passages 10A4, 10A3, 10B4, and 10B3 with respect to the plane including the X1-axis and the central axis 1*a*.

Figure 4:
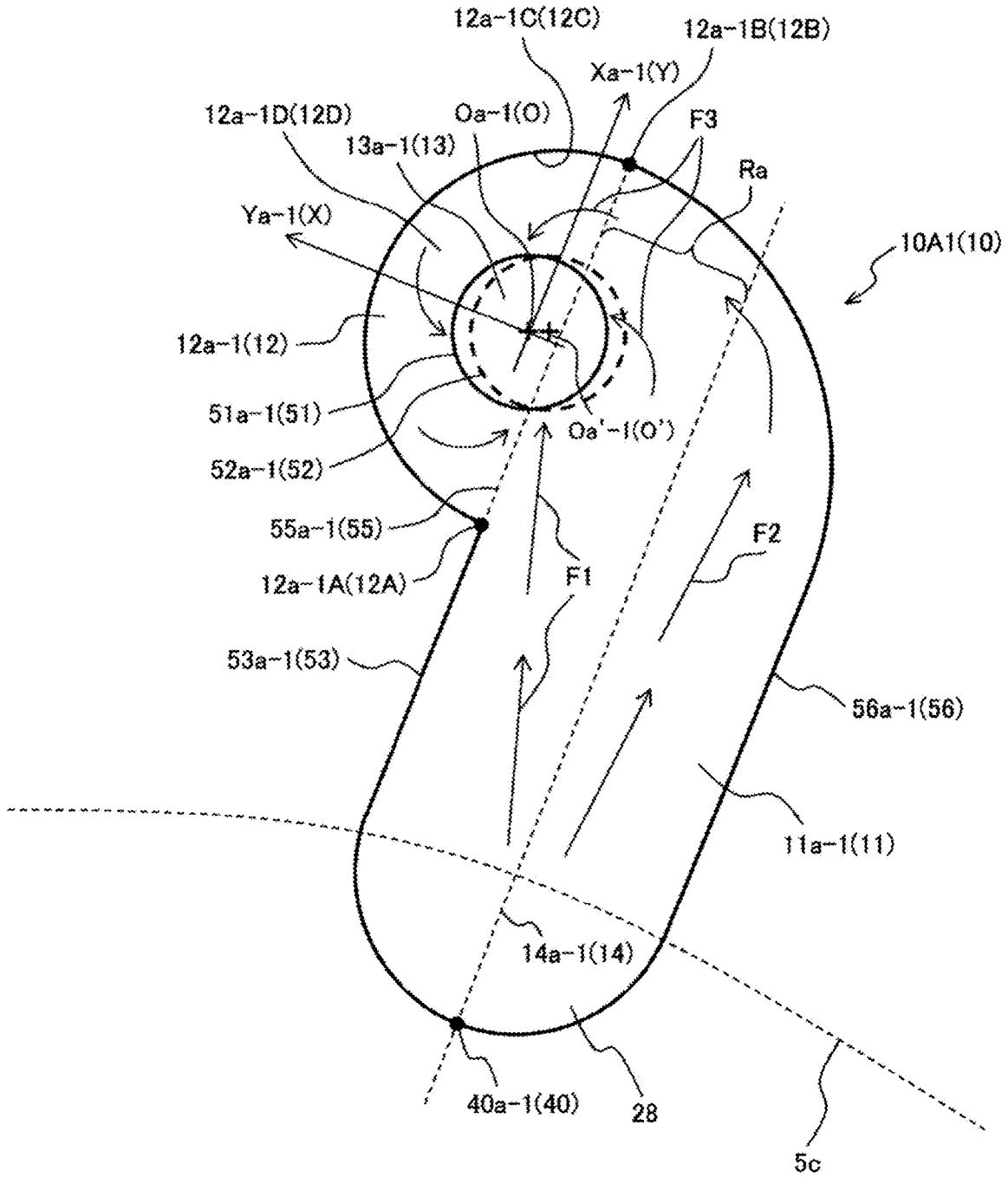
FIG. 4 shows flows F1, F2, and F3 with respect to a swirl fuel injection passage 10A1 (10) according to the first embodiment of the present invention.

A configuration of the swirl fuel injection passage 10A1 having the swirl passage 11*a*-1, the swirl chamber 12*a*-1, and the orifice 13*a*-1 will be described in detail with reference to FIG. 4. FIG. 4 shows flows F1, F2, and F3 with respect to the swirl fuel injection passage 10A1 (10) according to the first embodiment of the present invention. While FIG. 4 shows the configuration of the swirl fuel injection passage 10A1, the swirl fuel injection passages 10A2 to 10A4 and the swirl fuel injection passages 10B1 to 10B4 each have an identical configuration and achieve identical effects.

The swirl chamber introduction passage 11*a*-1, the swirl chamber 12*a*-1, and the orifice 13*a*-1 are configured as described below.

The swirl chamber 12*a*-1 has a side surface 12*a*-1C and includes a swirl passage portion 12*a*-1D. The side surface 12*a*-1C forms a circularly arcuate shape extending in a direction of a fuel flow. The swirl passage portion 12*a*-1D swirls the fuel. In the direction in which the fuel swirls, reference numeral 12*a*-1B denotes an end of the side surface 12*a*-1C disposed on an upstream side (upstream side end) and reference numeral 12*a*-1A denotes an end of the side surface 12*a*-1C disposed on a downstream side (downstream side end). The circularly arcuate shape of the side surface 12*a*-1C is illustrative only and the side surface 12*a*-1C may have a curved shape that draws, for example, a spiral curve or an involute curve.

The swirl chamber introduction passage 11*a*-1 connects with the swirl chamber 12*a*-1 and guides fuel into the swirl chamber 12*a*-1. A centerline 14*a*-1 of the swirl chamber introduction passage 11*a*-1 is first defined. The centerline 14*a*-1 extends in the direction in which the fuel flows. The centerline 14*a*-1 passes through a center in a width direction of the swirl chamber introduction passage 11*a*-1. The centerline 14*a*-1 exists not only in a portion of the swirl chamber introduction passage 11*a*-1, but also beyond the portion of the swirl chamber introduction passage 11*a*-1.

The swirl chamber introduction passage 11*a*-1 may be referred to as a lateral passage, a radial passage, or a swirl passage. The swirl chamber introduction passage 11*a*-1 has side surfaces 53*a*-1 and 56*a*-1 on both ends in the width direction. The side surface 53*a*-1 connects with the downstream side end 12*a*-1A of the swirl chamber side surface 12*a*-1C. The side surface 56*a*-1 connects with the upstream side end 12*a*-1B of the swirl chamber side surface 12*a*-1C.

In the present embodiment, the side surfaces 53*a*-1 and 56*a*-1 each include a linear-shaped portion (planar-shaped portion) extending in parallel with each other. The linear-shaped portions are not, however, required to extend in parallel with each other. Each of the linear-shaped portions may be tapered from the upstream side toward the downstream side. Alternatively, the side surfaces 53*a*-1 and 56*a*-1 may each be configured, for example, generally into a curved portion without having the linear-shaped portion.

In FIG. 4, imagine an extension 55*a*-1 that represents the side surface 53*a*-1 extended in the direction of the centerline 14*a*-1 of the swirl chamber introduction passage 11*a*-1. The position at which the extension 55*a*-1 crosses the swirl chamber side surface 12*a*-1C is the end (upstream side end) 12*a*-1B of the swirl chamber side surface 12*a*-1C. Specifically, with respect to the extension 55*a*-1 of the side surface 53*a*-1 as a boundary, the right-hand side in FIG. 4 is the swirl chamber introduction passage 11*a*-1 and the left-hand side in FIG. 4 is the swirl chamber 12*a*-1. To state the foregoing differently, with respect to the extension 55*a*-1 of the side surface 53*a*-1 as a boundary, the side through which the centerline 14*a*-1 of the swirl chamber introduction passage 11*a*-1 passes is the swirl chamber introduction passage 11*a*-1 and the side opposite thereto is the swirl chamber 12*a*-1.

In this case, the side surface 53*a*-1 is disposed on the side of the swirl chamber 12*a*-1 and the orifice 13*a*-1 with respect to the centerline 14*a*-1 and the side surface 56*a*-1 is disposed on the side opposite to the side of the swirl chamber 12*a*-1 and the orifice 13*a*-1 with respect to the centerline 14*a*-1.

The side surfaces 53*a*-1 and 56*a*-1 are connected with each other at a position indicated by reference numeral 40*a*-1 on an upstream end of the swirl chamber introduction passage 11*a*-1. In the present embodiment, the upstream end of the swirl chamber introduction passage 11*a*-1 is formed into a circularly arcuate shape as shown in FIG. 4. The position indicated by reference numeral 40*a*-1 is where the circularly arcuate shape crosses the centerline 14*a*-1 of the swirl chamber introduction passage 11*a*-1. The shape of the upstream end of the swirl chamber introduction passage 11*a*-1 is not limited only to the circularly arcuate shape and may, for example, be a bent planar shape.

In FIG. 4, a bottom surface of the swirl chamber introduction passage 11*a*-1 and a bottom surface of the swirl chamber 12*a*-1 (or the swirl passage portion 12*a*-1D) are visible in portions indicated as the swirl chamber introduction passage 11*a*-1 and the swirl chamber 12*a*-1 (or the swirl passage portion 12*a*-1D).

The orifice 13*a*-1 has an inlet opening surface 51*a*-1 communicating with the bottom surface of the swirl chamber 12*a*-1. The inlet opening surface 51*a*-1 as part of the fuel passage constitutes a passage cross section and will thus be referred to, in the following, as an inlet cross section (orifice inlet cross section). The orifice 13*a*-1 has an outlet opening surface 52*a*-1. The outlet opening surface 52*a*-1 is formed on a downstream end of the orifice 13*a*-1 and communicates with the outside. The outlet opening surface 52*a*-1 as part of the fuel passage constitutes a passage cross section and will thus be referred to, in the following, as an outlet cross section (orifice outlet cross section).

Let Oa-1 denote the center of the orifice inlet cross section 51*a*-1 and let Oa'-1 denote the center of the orifice outlet cross section 52*a*-1. Let Xa-1 denote an axis that passes through the center Oa-1 of the orifice inlet cross section 51*a*-1 and extends in parallel with the central axis (centerline) 14*a*-1 of the swirl chamber introduction passage 11*a*-1. The Xa-1 axis is positive in a direction from the upstream side toward the downstream side of the swirl chamber introduction passage 11*a*-1. Let Ya-1 denote an axis that passes through the center Oa-1 of the orifice inlet cross section 51*a*-1 and is perpendicular to the Xa-1 axis. The Ya-1 axis is positive in a direction away from the centerline 14*a*-1 of the swirl chamber introduction passage 11*a*-1. The Xa-1 axis and the Ya-1 axis extend in parallel with the end face of the nozzle plate 6. The end face of the nozzle plate 6 extends in parallel with a drawing plane of FIG. 4 (imaginary plane) extending perpendicularly to the central axis 1*a*.

As such, in the present embodiment, a rectangular coordinate system having the center Oa-1 as an origin and the Xa-1 axis and the Ya-1 axis as coordinate axes is defined.

In the present embodiment, the swirl passage 11*a*-1, the swirl chamber 12*a*-1, and the orifice 13*a*-1 are configured such that a part of the orifice inlet cross section 51*a*-1 overlaps a region Ra sandwiched between the extension 55*a*-1 of the side surface 53*a*-1 of the swirl chamber introduction passage 11*a*-1 and the centerline 14*a*-1 of the swirl chamber introduction passage 11*a*-1. Specifically, the part of the orifice inlet cross section 51*a*-1 communicates with a bottom portion of the swirl chamber 12*a*-1 and other parts of the orifice inlet cross section 51*a*-1 communicate with the bottom surface of the swirl chamber introduction passage 11*a*-1. In this case, in a projection (plan view) of the extension 55*a*-1 and the orifice inlet cross section 51*a*-1 projected onto an imaginary plane (the drawing plane of FIG. 4 or the end face of the nozzle plate 6) that is orthogonal to the central axis 1*a*, the extension 55*a*-1 traverses the orifice inlet cross section 51*a*-1.

Through the foregoing configuration, fuel introduced from the fuel introduction port 28 forms a main flow F1 that directly flows into the orifice 13*a*-1 and a subsidiary flow F2. The subsidiary flow F2 induces a swirl flow F3 around the orifice 13*a*-1.

With a configuration different from the configuration of the present embodiment, in which the orifice inlet cross section 51*a*-1 does not overlap the region Ra sandwiched between the extension 55*a*-1 of the side surface 53*a*-1 of the swirl chamber introduction passage and the centerline 14*a*-1 of the swirl chamber introduction passage, a good part of the flow flowing in the orifice 13*a*-1 are the swirl flow F3 with very little of the main flow F1 flowing directly into the orifice 13*a*-1. In this case, the fuel that has flowed in the orifice 13*a*-1 becomes a spray that spreads widely immediately below the orifice 13*a*-1 because of the strong swirl flow involved.

The disposition of the orifice 13*a*-1 such that the part of the orifice inlet cross section 51*a*-1 overlaps the region Ra as in the present embodiment generates the flow F1 that directly flows into the orifice 13*a*-*l*, resulting in a reduced ratio of the swirl flow F3 around the orifice 13*a*-*l*. This allows the fuel spray formed immediately below the orifice 13*a*-1 to be prevented from spreading.

The ratio of the flow F1 flowing directly in the orifice 13*a*-1 decreases and the ratio of the swirl flow F3 increases at greater distances of the center Oa-1 of the orifice inlet cross section 51*a*-1 from the centerline 14*a*-1 of the swirl chamber introduction passage. In contrast, the ratio of the flow F1 flowing directly in the orifice 13*a*-1 increases and the ratio of the swirl flow F3 decreases at closer distances of the center Oa-1 of the orifice inlet cross section from the centerline 14*a*-1 of the swirl chamber introduction passage. Thus, the position of the orifice 13*a*-1 may be varied depending on use, so that the ratio of the flow F1 flowing in the orifice 13*a*-1 can be varied and an angle of spray spreading immediately below the orifice 13*a*-1 can be varied.

Reference numerals 11*a*-1, 12*a*-1, 12*a*-1A, 12*a*-1B, 12*a*-1C, 12*a*-1D, 13*a*-1, 14*a*-1, 40*a*-1, 51*a*-*l*, 52*a*-1, 53*a*-1, 55*a*-1, 56*a*-1, Oa-1, Oa'-1, Xa-1, and Ya-1 are components of the swirl fuel injection passage 10A1 and thus each contain "a-1." When the description is applicable to not only the swirl fuel injection passage 10A1, but also other swirl fuel injection passages 10, however, the reference numerals may not contain "a-1" and may read 11, 12, 12A, 12B, 12C, 12D, 13, 14, 40, 51, 52, 53, 55, 56, O, O', X, and Y.

Figure 5:
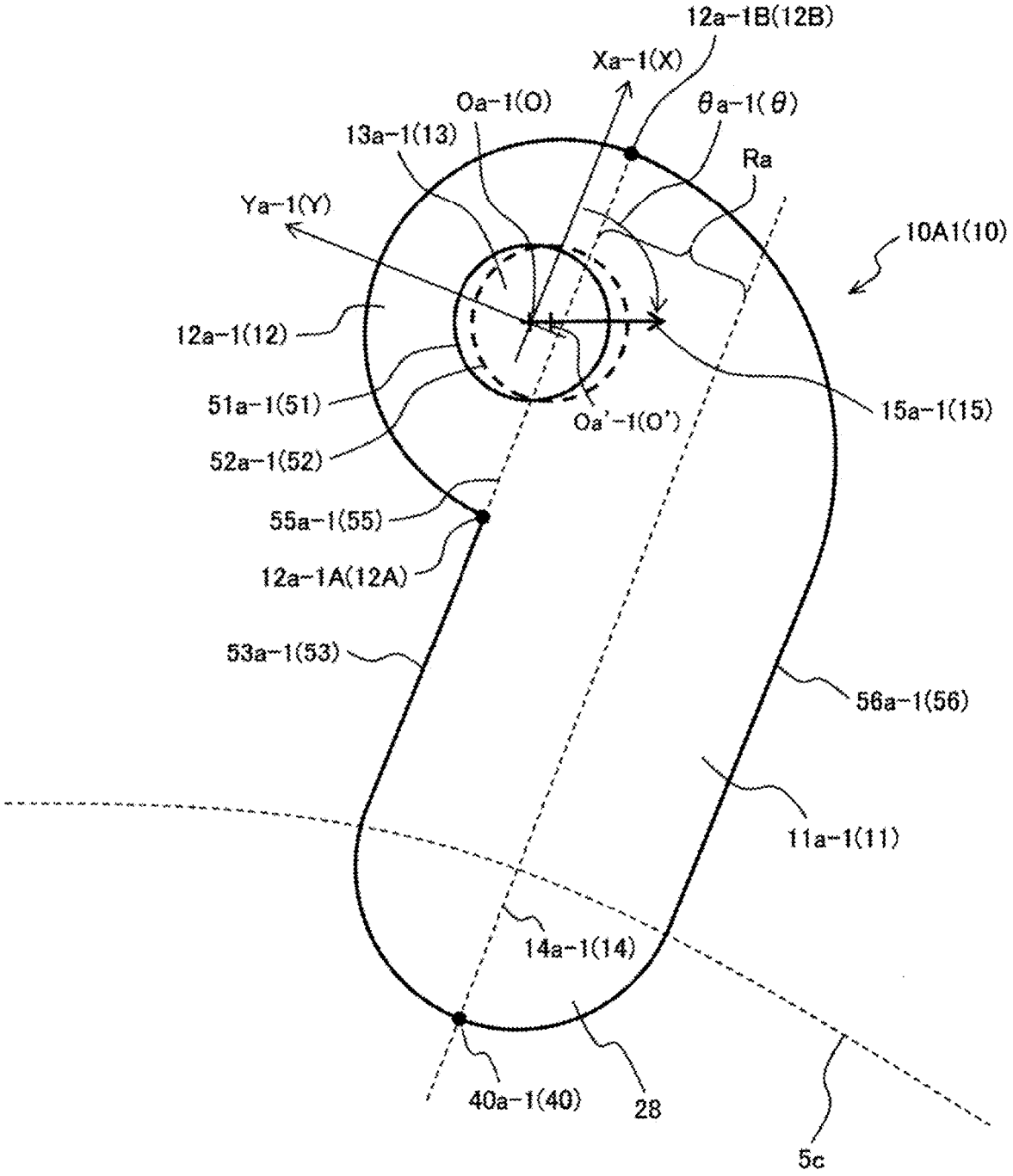
FIG. 5 shows an inclination direction 15*a*-1 of an orifice 13*a*-1 (13) with respect to the swirl fuel injection passage 10A1 (10) according to the first embodiment of the present invention.

An inclination direction of the orifice will be described below with reference to FIG. 5. FIG. 5 shows an inclination direction 15*a*-1 of the orifice 13*a*-1 (13) with respect to the swirl fuel injection passage 10A1 (10) according to the first embodiment of the present invention. While FIG. 5 shows the configuration of the swirl fuel injection passage 10A1, the same description applies to the swirl fuel injection passages 10A2 to 10A4 and the swirl fuel injection passages 10B1 to 10B4.

Project a straight line that passes through the center Oa-1 of the orifice inlet cross section 51*a*-1 and the center Oa'-1 of the orifice outlet cross section 52*a*-1 onto the end face of the nozzle plate 6 (plane perpendicular to the central axis 1*a*). The resultant projection line (arrow) is denoted as the orifice inclination direction 15*a*-1. With the positive direction of the Xa-1 axis being 0°, an angular direction of rotation from an angular position of 0° toward the centerline 14*a*-1 of the swirl chamber introduction passage is defined as a positive angular direction. Let θa-1 be an angle formed at this time between the Xa-1 axis and the orifice inclination direction 15*a*-1 (orifice inclination angle). The orifice inclination direction is defined for each of the other swirl chamber introduction passages, swirl chambers, and orifices through the same procedure. Specifically, the inclination angles of the respective orifices are defined as 8*a*-1, 6*b*-1, 6*c*-1, 6*d*-1, 8*a*-2, 6*b*-2, 6*c*-2, and 6*d*-2 as shown in FIG. 3.

When the swirl fuel injection passage is not differentiated among the swirl fuel injection passages 10A2 to 10A4 and the swirl fuel injection passages 10B1 to 10B4 in the descriptions that follow, the inclination direction 15*a*-1 and the inclination angle θa-1 may be referred to simply as the inclination direction 15 and the inclination angle G.

The swirl chamber introduction passage 11, the swirl chamber 12, and the orifice 13 are configured in the present embodiment such that the following holds: $0<\theta a\text{-}1<180°$, $0<\theta b\text{-}1<180°$, $0<\theta c\text{-}1<180°$, $0<\theta d\text{-}1<180°$, $0<\theta a\text{-}2<180°$, $0<\theta b\text{-}2<180°$, $0<\theta c\text{-}2<180°$, and $0<\theta d\text{-}2<180°$.

The foregoing configurations reduce the ratio of the swirl flow F3 and generate the flow F1 flowing directly in the orifice 13*a*-1 to thereby enable the spread of the fuel spray (spread angle) injected from the orifice 13*a*-1 to be reduced. Furthermore, the swirl chamber introduction passage 11*a*-1, the swirl chamber 12*a*-1, and the orifice 13*a*-1 are configured such that θa-1 falls within the above range. This arrangement increases a collision force of fuel on an inner wall surface of the orifice 13 to thereby allow atomization of fuel to be promoted. The foregoing configurations and arrangement are incorporated in the other swirl fuel injection passages 10, in addition to the swirl fuel injection passage 10A1. Thus, the spread of spray (spread angle) can be reduced and atomization can be promoted in all swirl fuel injection passages 10.

Specifically, in accordance with the present embodiment, the strength of the swirling force is adjusted through the disposition of the orifice 13, to thereby prevent the spray from spreading, and the collision force of fuel on the inner wall surface of the orifice 13 is increased through the setting of the inclination direction of the orifice 13, to thereby prevent atomization performance from being degraded or allow atomization performance to be improved. Sufficient atomization can be achieved while the spray is prevented from spreading.

A mechanism of atomization will be described in detail below.

Figure 6:
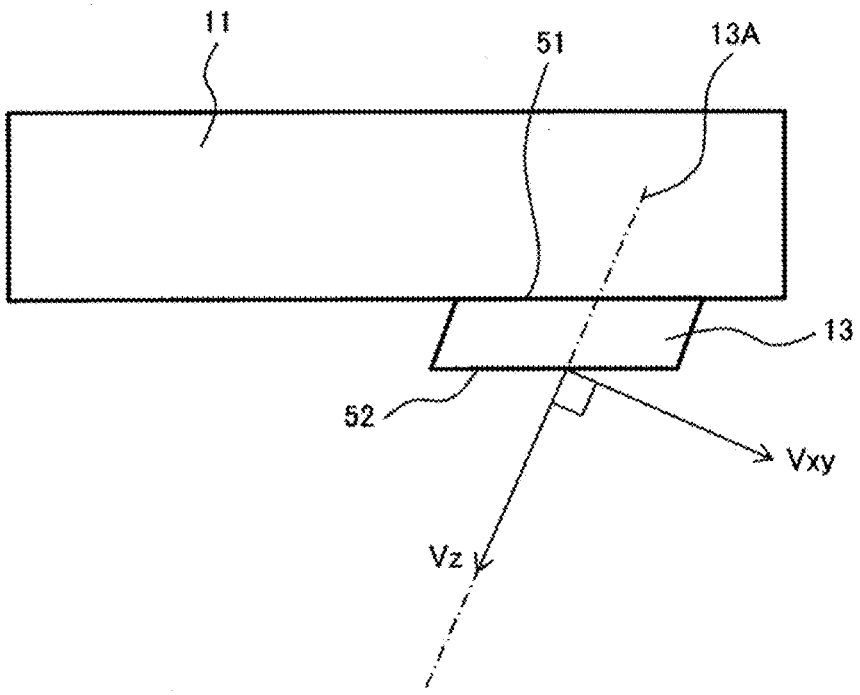
FIG. 6 is a side-elevational view of the swirl fuel injection passage 10 according to the first embodiment of the present invention.

FIG. 6 is a side-elevational view of the swirl fuel injection passage 10 according to the first embodiment of the present invention.

Reference is made to FIG. 6. Let Vz be a velocity component in a direction of an axis 13A (direction of a centerline 13A) of the orifice 13 in the orifice outlet cross section (orifice outlet opening surface) 52 and let Vxy be a velocity component in a planar direction perpendicular to the axis 13A of the orifice 13. When fuel passes through the orifice 13 with an increasing Vxy, droplets tend more readily to be broken down as a liquid film is formed, and atomization is promoted. Thus, atomization of fuel injected from the outlet opening surface 52 of the orifice 13 is promoted more with an increasing velocity component Vxy in the planar direction perpendicular to the axis 13A of the orifice 13.

As described previously, the present embodiment involves two types of fuel flow flowing from the inlet opening surface 51 in the orifice 13: the swirl flow F3 and the flow F1 that directly flows in the orifice 13. To use the swirl flow F3 to promote atomization, a swirl flow is generated in the orifice 13 by the swirl flow F3. The generation of the swirl flow causes the velocity component in the circumferential direction in the orifice 13*a*-1 to increase and the velocity component Vxy in the planar direction perpendicular to the axis 13A of the orifice 13 to increase, thereby promoting atomization. As such, when only the swirl flow F3 is used, the fuel swirls in the circumferential direction in the axis 13A, so that the inclination direction 15*a*-1 of the orifice 13 affects little the atomization of fuel.

To promote atomization using the flow F1 that directly flows in the orifice 13, the inclination direction θa-1 of the orifice 13 greatly affects.

Figure 7:
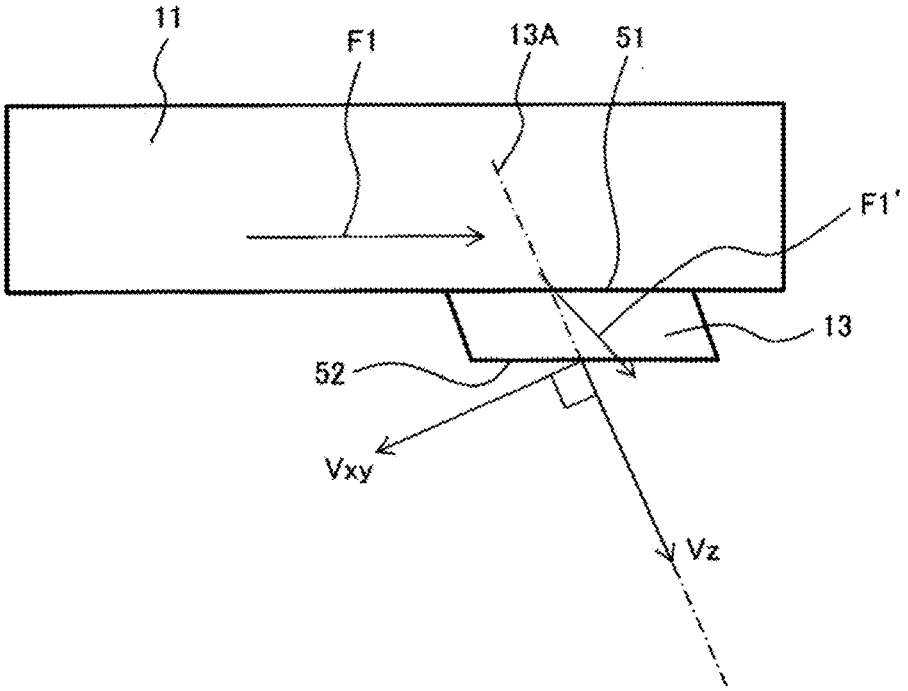
FIG. 7 is a side-elevational view of the swirl fuel injection passage 10 when an inclination direction of an orifice 13 is changed as a comparative example of the first embodiment of the present invention.

FIG. 7 is a side elevational view of the swirl fuel injection passage 10 when the inclination direction of the orifice 13 is changed as a comparative example of the first embodiment of the present invention.

FIG. 7 shows a configuration in which the orifice 13 is inclined in a direction identical to a flow line F1 direction in which fuel flowing from the swirl chamber introduction passage 11 into the orifice 13 flows. In this case, the flow F1 in the orifice 13 has an increased velocity component Vz in an orifice axial direction and a reduced Vxy. The configuration thus achieves only a marginal atomization effect.

Figure 8:
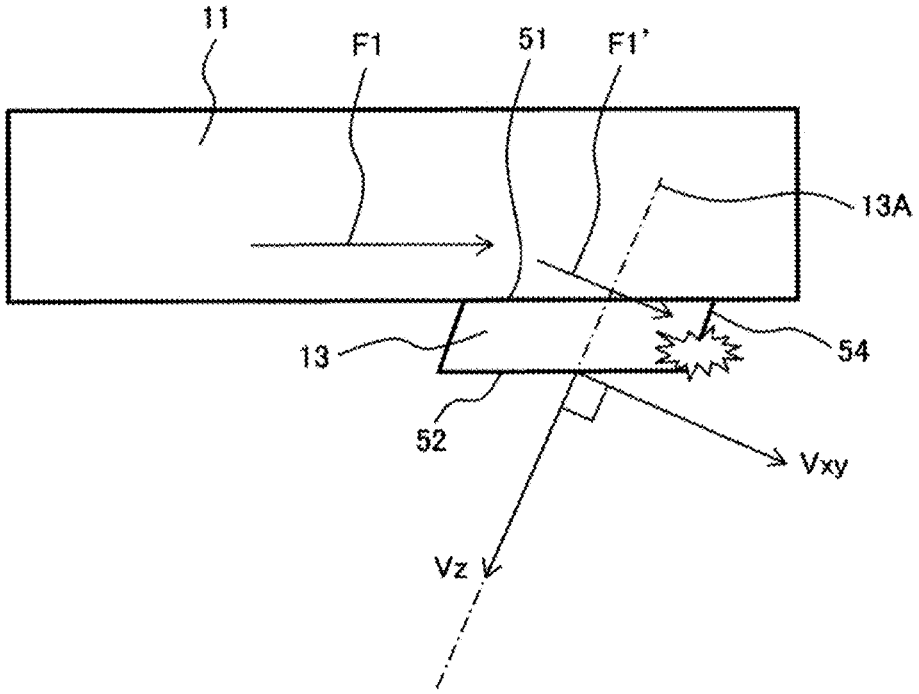
FIG. 8 is a side-elevational view of the swirl fuel injection passage 10 according to the first embodiment of the present invention, showing how fuel flows.

FIG. 8 is a side-elevational view of the swirl fuel injection passage 10 according to the first embodiment of the present invention, showing how fuel flows.

FIG. 8 shows a configuration in which the orifice 13 is inclined in a direction opposite to the flow line direction in which fuel flowing from the swirl chamber introduction passage 11 into the orifice 13 flows. In this case, a part F1' of the fuel collides against an inner wall 54 of the orifice 13, resulting in an increased velocity component Vxy in the planar direction perpendicular to the axis 13A direction of the orifice 13. As a result, the fuel that has passed through the orifice 13 forms a thin liquid film immediately below the orifice 13, which causes the droplet to tend to be broken down and atomization to be promoted. Additionally, an effect achieved by the fuel flow F1' to expand the spread of the spray is smaller than an effect achieved by the swirling fuel flow to expand the spread of the spray.

Figure 9:
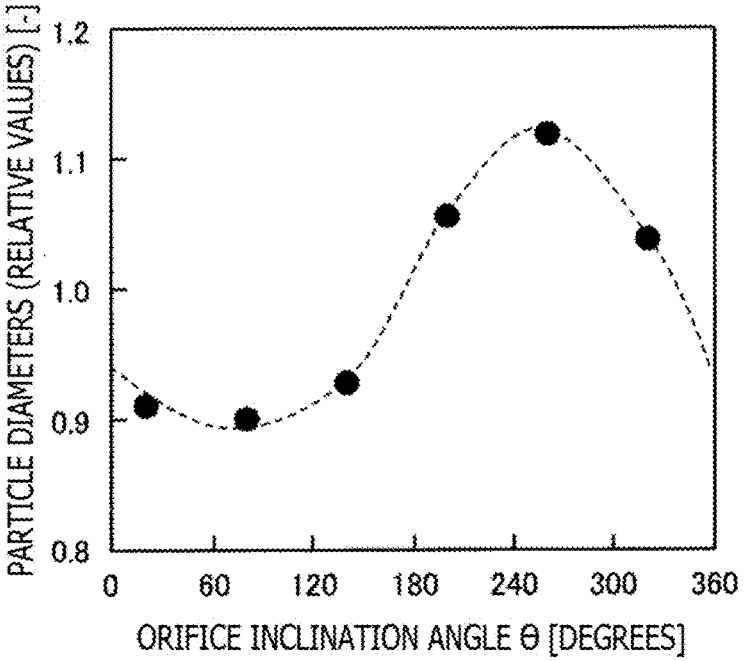
FIG. 9 shows simulation results of calculating relative values of particles when the inclination angle θ of the orifice 13 is varied.

Calculations of a fluid simulation of particle diameters when the orifice inclination angle θ is varied from 0° to 360° in FIG. 5 will be described below with reference to FIG. 9. FIG. 9 shows simulation results of calculating relative values of particles when the inclination angle θ of the orifice 13 is varied. FIG. 9 shows the relative values with respect to average values of the particle diameter.

FIG. 9 reveals that the particle diameter is smaller than the average value when the inclination angle θ of the orifice 13 falls within the following range: 0°<θ<180°. Thus, the swirl chamber introduction passage 11, the swirl chamber 12, and the orifice 13 are configured in the present embodiment such that the inclination angle G of the orifice 13 satisfies 0°<θ<1800.

Specifically, as shown in FIG. 3, each orifice 13, each swirl chamber 12, and each swirl chamber introduction passage 11 are configured such that the following holds: 0°<θa-1<180°, 0°<θb-1<180°, 0°<θc-1<180°, 0°<θd-1<180°, 0°<θa-2<180°, 0°<θb-2<180°, 0°<θc-2<180°, and 0°<θd-2<180°. Furthermore, the following holds at this time: θa-1>θb-1, θd-1>θc-1, θa-2>θb-2, and θd-2>θc-2. Through the foregoing configurations, atomization can be promoted without the use of a strong swirl flow and the spray under the orifice can be prevented from spreading. A spray formed as a result exhibits high atomization performance and is oriented in two directions.

Figure 10:
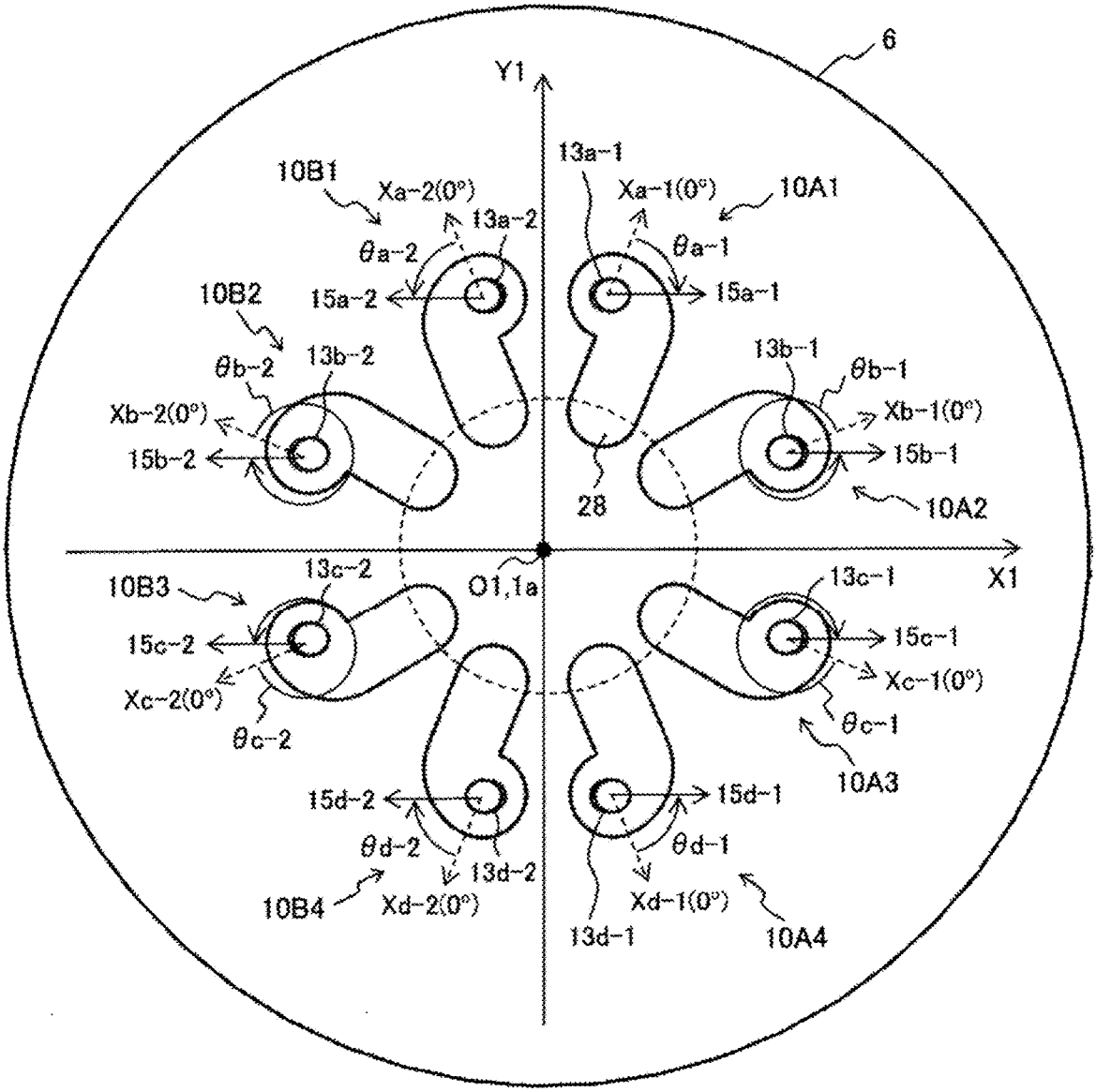
FIG. 10 shows a nozzle plate 6 in a fuel injection valve 1 according to a variation of the first embodiment of the present invention, as viewed from a valve element side (proximal end side).

A variation of the present embodiment will be described below with reference to FIG. 10. FIG. 10 shows a nozzle plate 6 in a fuel injection valve 1 according to a variation of the first embodiment of the present invention, as viewed from a valve element side (proximal end side).

In the present variation, swirl chamber introduction passages, swirl chambers, and orifices are configured such that the inclination angle θ of some orifices satisfies 0°<θ<180° as shown in FIG. 10, instead of all orifices 13 having the above inclination angle. For example, the following holds in FIG. 10: 0°<θa-1<180°, 0°<θd-1<180°, 0°<θa-2<180°, and 0°<θd-2<180°; and 180°<θb-1<360°, 180°<θc-1<360°, 180°<θb-2<360°, and 180°<θc-2<360°. The configuration in which the orifice 13 is disposed such that a part of the orifice inlet cross section overlaps the region Ra shown in FIGS. 4 and 5 is the same as in the first embodiment.

In this case, the orifices 13*a*-1, 13*d*-1, 13*a*-2, and 13*d*-2 that satisfy 0°<θ<180° function as orifices promoting atomization of the fuel that has passed. In contrast, the other orifices 13*b*-1, 13*c*-1, 13*b*-2, and 13*c*-2 function, for example, as orifices preventing the spray from spreading. By assigning a specific task to each orifice as described above, a nozzle plate 6 can be configured so as to suit a specific purpose.

The present embodiment is configured such that the swirl chamber introduction passage 11 is disposed on the center O1 side of the nozzle plate 6 and the orifice 13 is disposed on the outer peripheral side of the nozzle plate 6 with respect to the swirl chamber introduction passage 11 in order for the fuel to flow from the area near the center O1 of the nozzle plate 6 toward the outside in the radial direction. A distance between two adjacent orifices can be widened more when the orifices 13 are disposed at positions closer to the outer peripheral side of the nozzle plate 6. Thus, fuel injected from a first orifice 13 can be prevented from interfering with fuel injected from a second orifice 13 in the area immediately below the first orifice 13. The fuel injected from the first orifice 13 can have a large particle diameter when interfering with the fuel injected from the second orifice 13 in the area immediately below the first orifice 13.

Furthermore, the present embodiment can increase the number of orifices 13 because the distance between the adjacent orifices can be increased as described above. An increased number of orifices 13 with an overall flow rate of fuel remaining unchanged reduces a cross-sectional area of each orifice 13. Thus, the fuel injected from the orifice 13 can have an even thinner film for the further improved atomization performance. Meanwhile, in the configuration as disclosed in Patent Document 2 (JP-2011-202513-A), in which fuel flows from the outer peripheral side toward the center of the nozzle plate, the distance between the adjacent orifices is small and interference of fuel can occur in the area immediately below the orifice. Increasing the number of orifices is not easy, either, for the reason described above.

Figure 11:
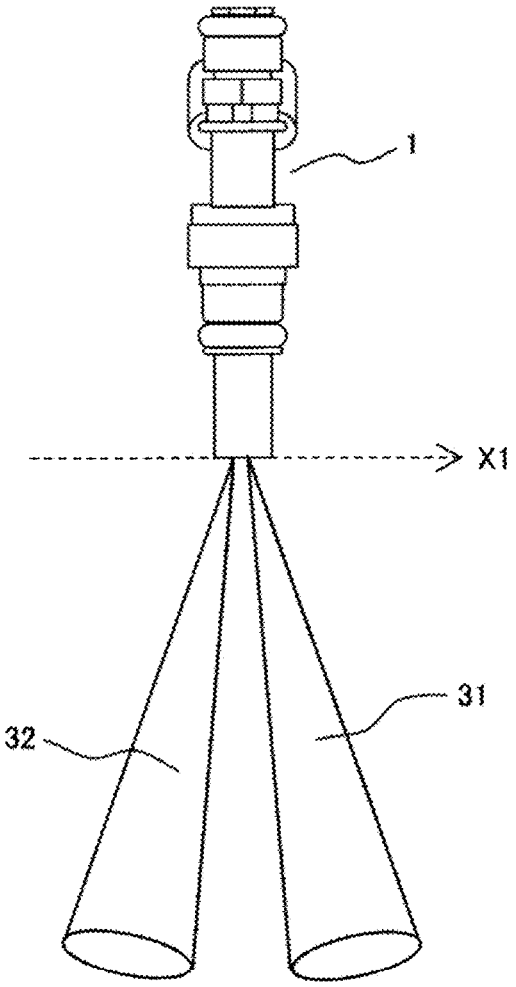
FIG. 11 is an illustrative view of a spray form of the fuel injection valve 1 according to the first embodiment of the present invention, as viewed from a Y1-axis direction.
Figure 12:
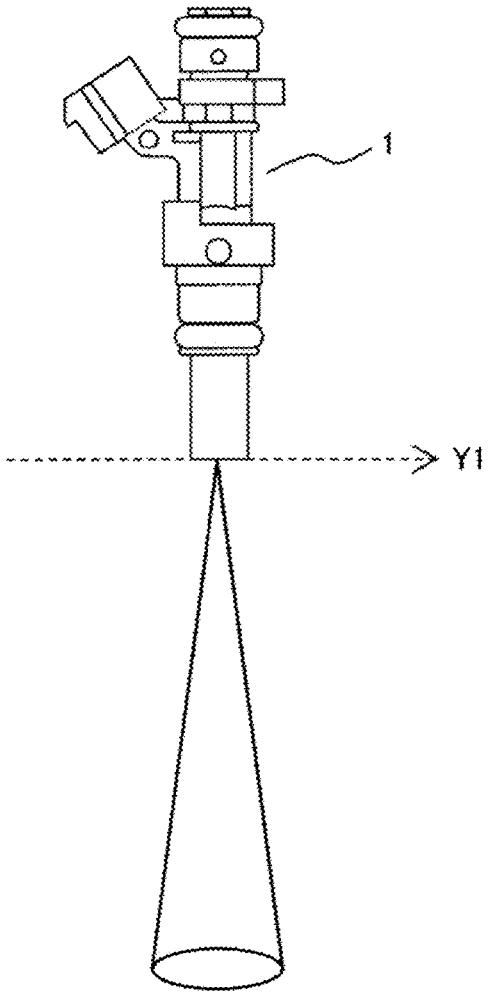
FIG. 12 is an illustrative view of a spray form of the fuel injection valve 1 according to the first embodiment of the present invention, as viewed from an X1-axis direction.

Forms of sprays injected from the fuel injection valve 1 will be described below with reference to FIGS. 11 and 12. FIG. 11 is an illustrative view of a spray form of the fuel injection valve 1 according to the first embodiment of the present invention, as viewed from the Y1-axis direction. FIG. 12 is an illustrative view of the spray form of the fuel injection valve 1 according to the first embodiment of the present invention, as viewed from the X1-axis direction.

In the configuration of the present embodiment, fuel that has passed through each of the orifices 13*a*-1, 13*b*-1, 13*c*-1, and 13*d*-1 forms a first spray 31 oriented in a first direction, and fuel that has passed through each of the orifices 13*a*-2, 13*b*-2, 13*c*-2, and 13*d*-2 forms a second spray 32 oriented in a direction different from the first direction. Specifically, the swirl fuel injection passages 10 are divided into a first swirl fuel injection passage group that includes the swirl fuel injection passages 10A1 to 10A4 and that forms the first spray 31 and a second swirl fuel injection passage group that includes the swirl fuel injection passages 10B1 to 10B4 and that forms the second spray 32.

A spray in one direction is formed when viewed from the +X1 direction as shown in FIG. 12. Thus, in accordance with the configuration of the present embodiment, sprays oriented in two directions can be formed.

Second Embodiment

Figure 13:
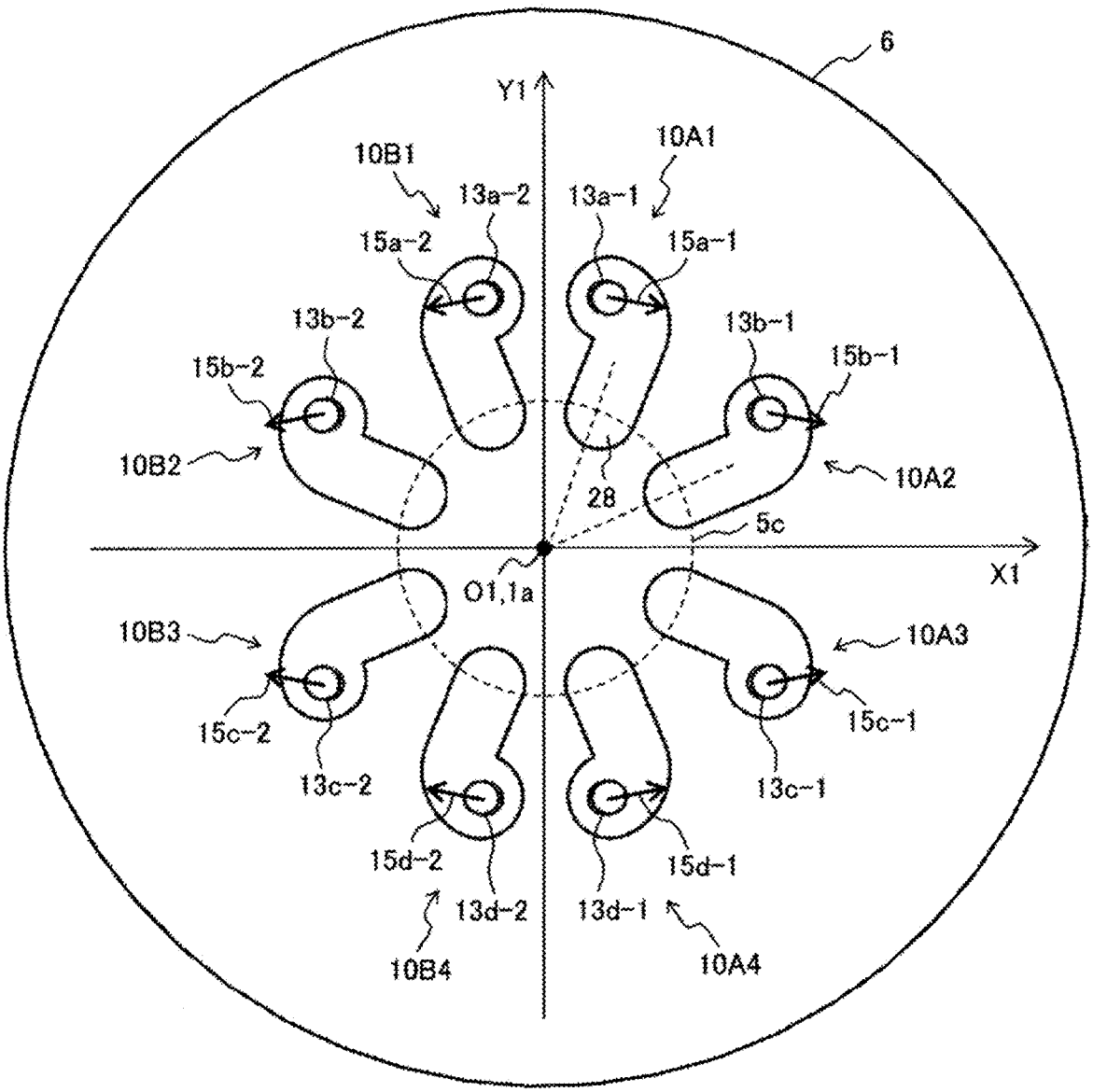
FIG. 13 shows a nozzle plate 6 in a fuel injection valve 1 according to a second embodiment of the present invention, as viewed from a valve element side (proximal end side).

A second embodiment of the present invention will be described below with reference to FIG. 13. FIG. 13 shows a nozzle plate 6 in a fuel injection valve 1 according to a second embodiment of the present invention, as viewed from a valve element side (proximal end side).

The second embodiment differs from the first embodiment in that an orifice 13 in the second embodiment has an inclination angle different from the inclination angle of the orifice 13 of the first embodiment. The second embodiment is configured similarly to the first embodiment in other respects.

As in the first embodiment, in the present embodiment, swirl fuel injection passages 10A1 and 10A2 and swirl fuel injection passages 10A3 and 10A4 are disposed on both sides of the X1-axis (in the first quadrant and the fourth quadrant, respectively) and swirl fuel injection passages 10B1 and 10B2 and swirl fuel injection passages 10B3 and 10B4 are disposed on both sides of the X1-axis (in the second quadrant and the third quadrant, respectively). Additionally, the present embodiment is configured such that extensions of inclination directions 15*a*-1 and 15*b*-1 of orifices 13*a*-1 and 13*b*-1, respectively, and extensions of inclination directions 15*c*-1 and 15*d*-1 of orifices 13*c*-1 and 13*d*-1, respectively, cross a portion of X1>0 (positive range) of the X1-axis. The present embodiment is further configured such that extensions of inclination directions 15*a*-2 and 15*b*-2 of orifices 13*a*-2 and 13*b*-2, respectively, and extensions of inclination directions 15*c*-2 and 15*d*-2 of orifices 13*c*-2 and 13*d*-2, respectively, cross a portion of X1<0 (negative range) of the X1-axis.

Through the foregoing configurations, fuel injected from each of the orifices 13*a*-1, 13*b*-1, 13*c*-1, and 13*d*-1 forms the spray 31 shown in FIG. 11 and fuel injected from each of the orifices 13*a*-2, 13*b*-2, 13*c*-2, and 13*d*-2 forms the spray 32 shown in FIG. 11, so that sprays in two directions can be formed. Furthermore, in the present embodiment, the inclination direction of each of the orifices 13 is inclined so as to approach the X1-axis. Thus, the fuel injected from each of the orifices 13 attracts each other, so that even finer spray 31 and spray 32 can be formed.

In the present embodiment, the inclination directions 15*a*-1 and 15*b*-1 of the orifices 13 is symmetrical with the inclination directions 15*c*-1 and 15*d*-1 of the orifices 13 with respect to a plane including the X1-axis and a central axis 1*a* and the orifices 13*a*-1, 13*b*-1, 13*c*-1, and 13*d*-1 are symmetrical with the orifices 13*a*-2, 13*b*-2, 13*c*-2, and 13*d*-2 with respect to a plane including a Y1-axis and the central axis 1*a*. The foregoing arrangement is illustrative only and not limiting. To form the spray 31 and the spray 32 asymmetrically with respect to the plane including the Y1-axis and the central axis 1*a*, for example, the orifices 13*a*-1, 13*b*-1, 13*c*-1, and 13*d*-1 may not have to be symmetrical with the orifices 13*a*-2, 13*b*-2, 13*c*-2, and 13*d*-2 with respect to the plane including the Y1-axis and the central axis 1*a*.

Third Embodiment

Figure 14:
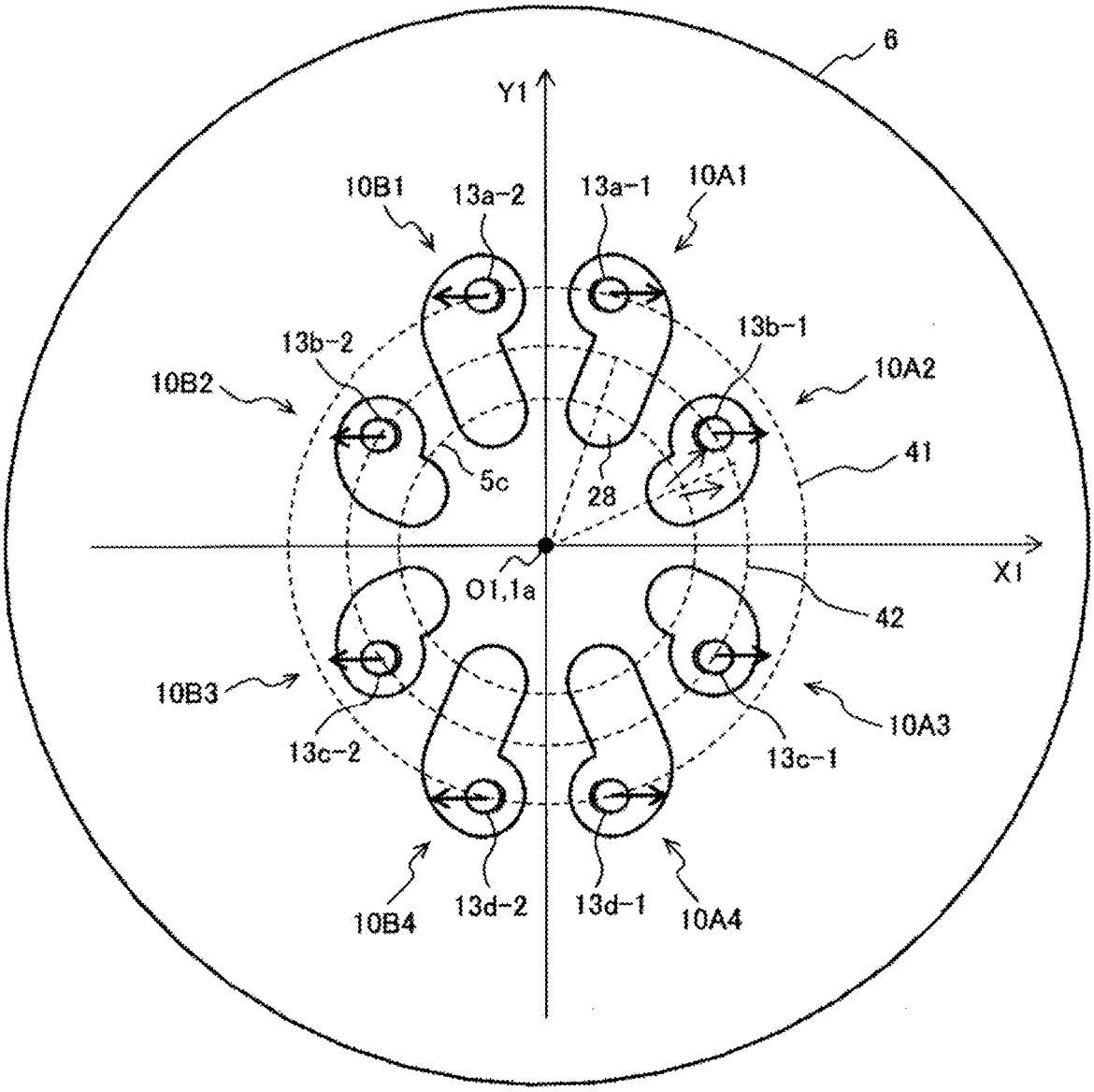
FIG. 14 shows a nozzle plate 6 in a fuel injection valve 1 according to a third embodiment of the present invention, as viewed from a valve element side (proximal end side).

A third embodiment of the present invention will be described below with reference to FIG. 14. FIG. 14 shows a nozzle plate 6 in a fuel injection valve 1 according to a third embodiment of the present invention, as viewed from a valve element side (proximal end side).

The nozzle plate 6 in the third embodiment differs from the nozzle plate 6 in the first embodiment in that the distance between the center O1 of the nozzle plate and an inlet center of each orifice 13 differs between different orifices 13. The nozzle plate 6 in the third embodiment is configured similarly in other respects to the nozzle plate 6 in the first or second embodiment.

In the present embodiment, a plurality of placement circles 41 and 42 are defined as placement circles of the orifices 13. The placement circles 41 and 42 have respective different radiuses from the center O1 of the nozzle plate 6. In the present embodiment, the two placement circles 41 and 42 are set and each of the orifices 13 is disposed on either one of the two placement circles 41 and 42. In the present embodiment, a center of an inlet opening surface (inlet center) of each of orifices 13*a*-1, 13*d*-1, 13*a*-2, and 13*d*-2 is disposed on the placement circle 41 and a center of an inlet opening surface of each of orifices 13*b*-1, 13*c*-1, 13*b*-2, and 13*c*-2 is disposed on the placement circle 42. In the present embodiment, the placement circle 41 has a diameter greater than a diameter of the placement circle 42.

The foregoing configuration prevents spray interference from occurring, in which fuel injected from the orifice 13*a*-1 interferes with fuel injected from the orifice 13*b*-1 in areas immediately below the respective orifices. The same holds for other orifices: specifically, the orifice 13*c*-1 and the orifice 13*d*-1, the orifice 13*a*-2 and the orifice 13*b*-2, and the orifice 13*c*-2 and the orifice 13*d*-2.

The present embodiment has been described for the configuration in which the center of the inlet opening surface of each of the orifices 13*a*-1, 13*d*-1, 13*a*-2, and 13*d*-2 is disposed on the placement circle 41 and the center of the inlet opening surface of each of the orifices 13*b*-1, 13*c*-1, 13*b*-2, and 13*c*-2 is disposed on the placement circle 42. The number of placement circles may be further increased or the orifices 13 may be disposed on respective different placement circles.

Fourth Embodiment

A fourth embodiment of the present invention will be described below with reference to FIG. 15.

In the present embodiment, a swirl chamber introduction passage 13 is extended to have a longer length. A smoothing effect in the swirl chamber introduction passage 13 is thereby improved and atomization of fuel injected from an orifice 13 is improved.

Figure 15:
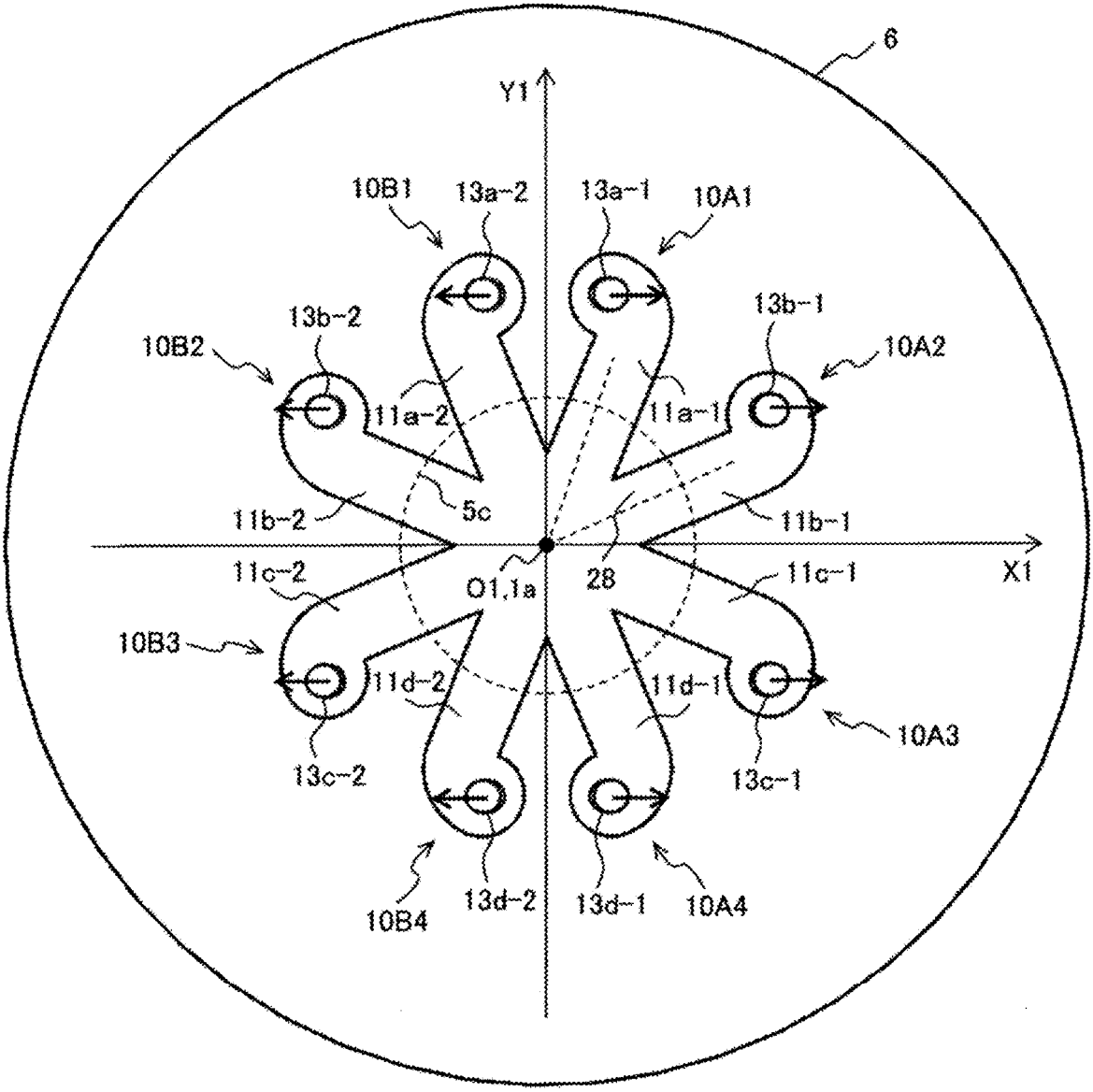
FIG. 15 shows a nozzle plate 6 in a fuel injection valve 1 according to a fourth embodiment of the present invention, as viewed from a valve element side (proximal end side).

FIG. 15 shows a nozzle plate 6 in a fuel injection valve 1 according to a fourth embodiment of the present invention, as viewed from a valve element side (proximal end side).

The nozzle plate 6 shown in FIG. 15 includes the swirl chamber introduction passage 11 that extends outwardly in the radial direction from a center O1 of the nozzle plate 6. The swirl chamber introduction passage 11 of each of swirl fuel injection passages 10A1 to 10A4 and swirl fuel injection passages 10B1 to 10B4 has an upstream side end connected with the center O1 of the nozzle plate 6.

In the foregoing configuration, fuel introduced from a fuel introduction port 28 flows through the swirl chamber introduction passage 11 and is guided onto each orifice 13, as in the first embodiment. Because the swirl chamber introduction passage 11 extends up to the center O1 of the nozzle plate 6 in the present embodiment, the fuel introduced from the fuel introduction port 28 is readily smoothed in the swirl chamber introduction passage 11 as compared with the first embodiment. As a result, the smoothed flow flows into the orifice 13, so that atomization is further promoted.

Figure 16:
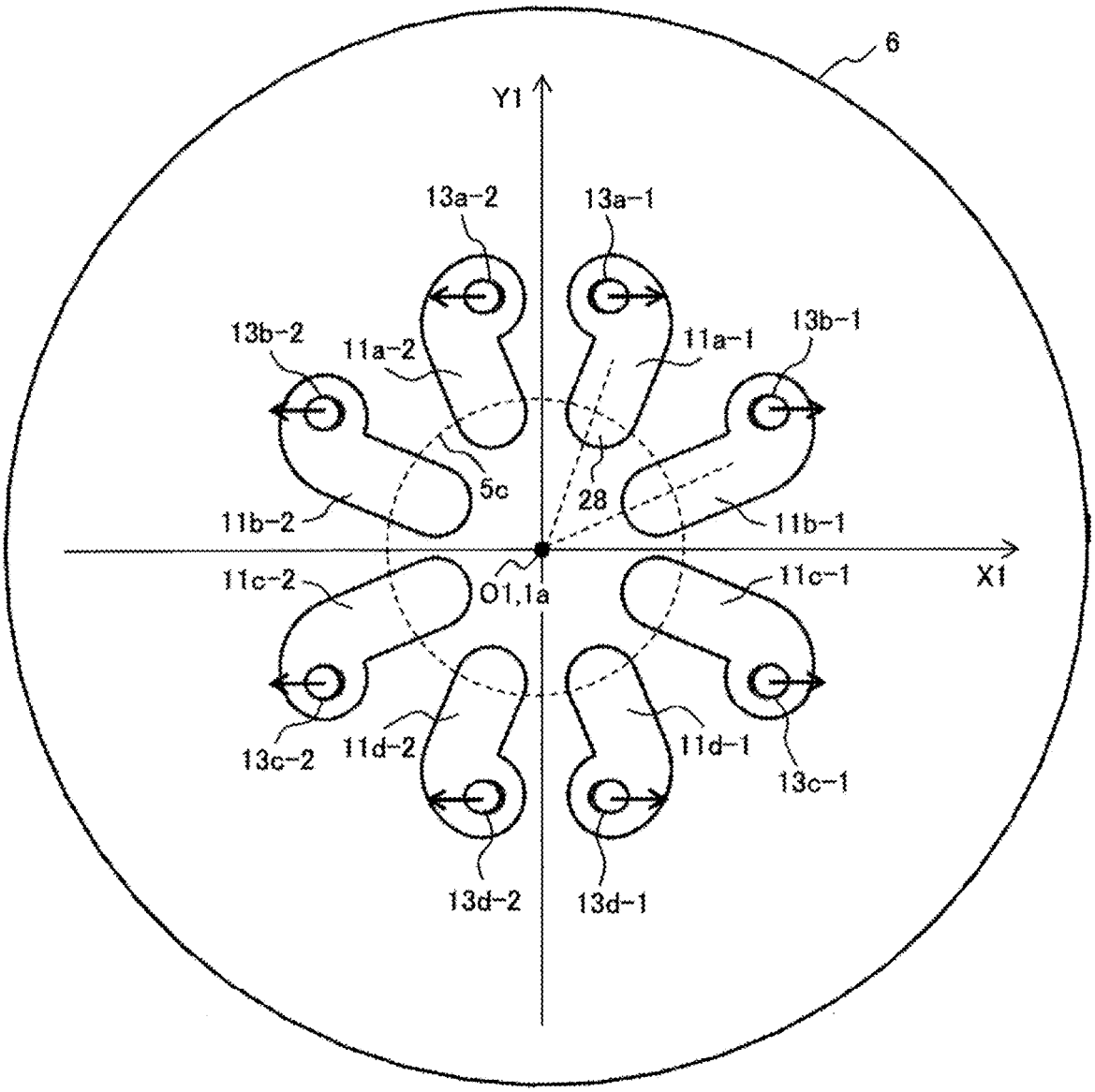
FIG. 16 shows a modification of the nozzle plate 6 according to the fourth embodiment of the present invention shown in FIG. 14, as viewed from a valve element side (proximal end side) of the nozzle plate 6.

FIG. 16 shows a modification of the nozzle plate 6 according to the fourth embodiment of the present invention shown in FIG. 14, as viewed from a valve element side (proximal end side) of the nozzle plate 6.

Each swirl chamber introduction passage 11 may be configured to have a specific length different from each other as shown in FIG. 16. In the present embodiment, swirl chamber introduction passages 11*b*-1, 11*c*-1, 11*b*-2, and 11*c*-2 have a length longer than a length of swirl chamber introduction passages 11*a*-1, 11*d*-1, 11*a*-2, and 11*d*-2. In this case, fuel that flows through each of the swirl chamber introduction passages 11*b*-1, 11*c*-1, 11*b*-2, and 11*c*-2 is smoothed more than fuel that flows through each of the swirl chamber introduction passages 11*a*-1, 11*d*-1, 11*a*-2, and 11*d*-2. As a result, atomization is promoted in fuel injected from orifices 13*b*-1, 13*c*-1, 13*b*-2, and 13*c*-2 through the swirl chamber introduction passages 11*b*-1, 11*c*-1, 11*b*-2, and 11*c*-2 having a longer length. A configuration is thus possible, in which each swirl chamber introduction passage 11 has a specific length different from each other.

In the nozzle plate 6 shown in FIG. 14, the orifices 13 are disposed on the different placement circles 41 and 42, to thereby substantially vary the length of the swirl chamber introduction passage 11 among the different swirl fuel injection passages 10.

Any configuration other than the above-described swirl chamber introduction passage 13 may be implemented by adopting configurations of other embodiments described above. For example, the configuration shown in FIG. 15 in which the swirl chamber introduction passages 11 have the upstream side ends connected with each other at the center O1 of the nozzle plate 6, may be combined with the configuration shown in FIG. 14 in which the orifices 13 are disposed on the different placement circles 41 and 42, to thereby implement a configuration in which the swirl chamber introduction passages 11 have different lengths among the different swirl fuel injection passages 10.

Fifth Embodiment

A fifth embodiment of the present invention will be described below with reference to FIG. 17.

Figure 17:
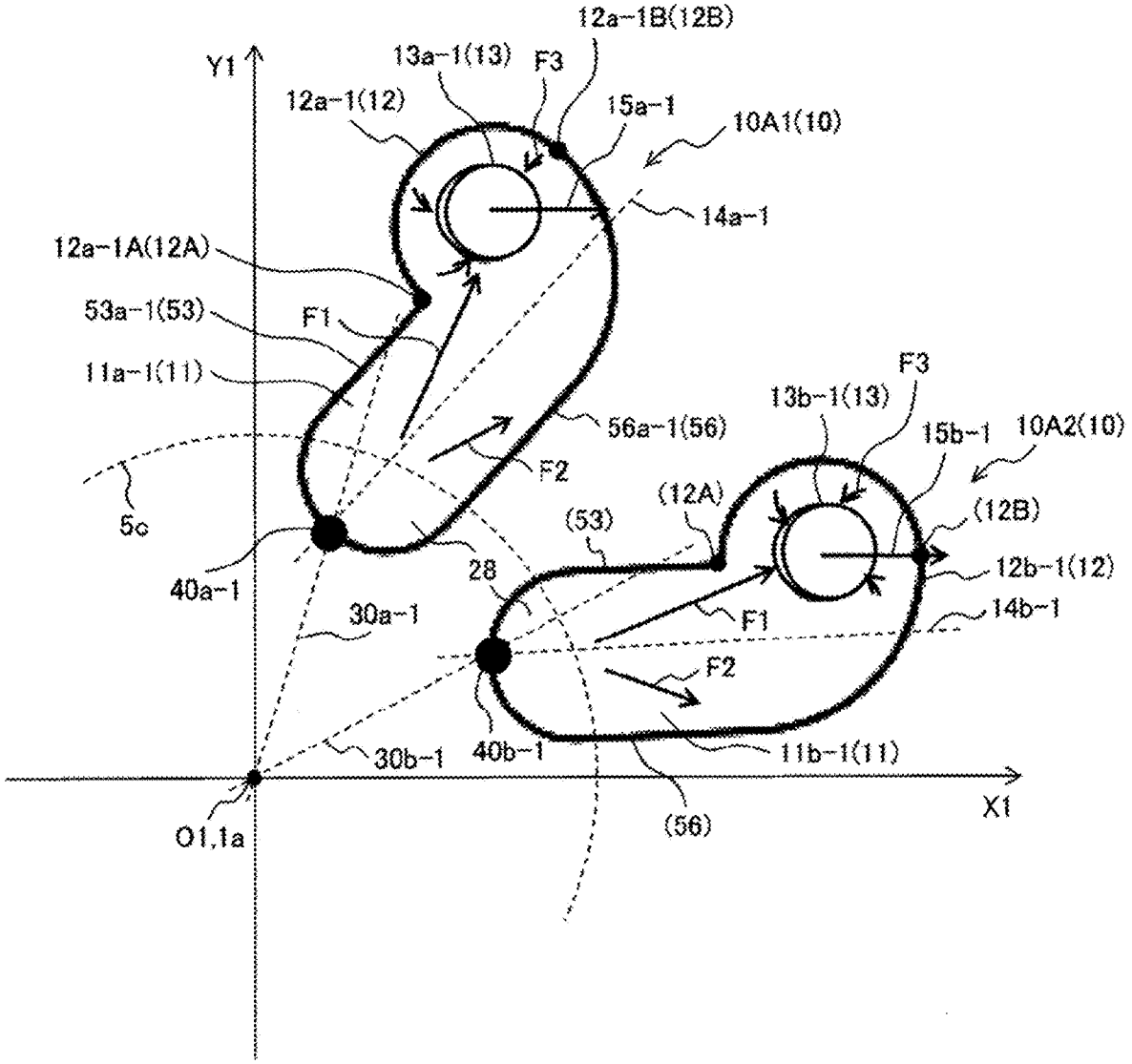
FIG. 17 shows a swirl fuel injection passage 10 in a fuel injection valve 1 according to a fifth embodiment of the present invention, as viewed from a valve element side (proximal end side).

FIG. 17 shows a swirl fuel injection passage 10 in a fuel injection valve 1 according to a fifth embodiment of the present invention, as viewed from a valve element side (proximal end side). It is noted that FIG. 17 shows an area near a swirl fuel injection passage 10A1 and a swirl fuel injection passage 10A2.

Let 14*a*-1 denote a centerline of the a swirl chamber introduction passage 11*a*-1 and let 14*b*-1 denote a centerline of a swirl chamber introduction passage 11*b*-1. Let 40*a*-1 denote an intersection point between the swirl chamber introduction passage 11*a*-1 and the centerline 14*a*-1. Let 40*b*-1 denote an intersection point between the swirl chamber introduction passage 11*b*-1 and the centerline 14*b*-1. Let 30*a*-1 denote a straight line connecting between a center O1 of a nozzle plate 6 and the intersection point 40*b*-1 and let 30*b*-1 denote a straight line connecting between the center O1 of the nozzle plate 6 and the intersection point 40*b*-1.

In the swirl fuel injection passage 10A1 in the present embodiment, the centerline 14*a*-1 is disposed, instead of residing on a straight line 30*a*-1 on which the centerline 14*a*-1 resides, to be rotated through a predetermined angle in a clockwise direction (toward an X1-axis) about the intersection point 40*a*-1 with respect to the straight line 30*a*-1.

Specifically, the swirl fuel injection passage 10A1 is disposed such that, instead of the centerline 14*a*-1 of the swirl chamber introduction passage 11*a*-1 overlapping the straight line 30*a*-1 on a single straight line, a side surface 53*a*-1 (53) in a fuel flow direction has a downstream side portion rotated in a direction (X1-axis direction) in which the downstream side portion approaches or crosses the straight line 30*a*-1. To state the foregoing differently, the swirl fuel injection passage 10A1 is disposed such that, instead of the centerline 14*a*-1 of the swirl chamber introduction passage 11*a*-1 overlapping the straight line 30*a*-1 on a single straight line, a side surface 56*a*-1 (56) in the fuel flow direction has a downstream side portion rotated in a direction (X1-axis direction) in which the downstream side portion is spaced away from the straight line 30*a*-1. Or, the swirl fuel injection passage 10A1 is disposed such that, instead of the centerline 14*a*-1 of the swirl chamber introduction passage 11*a*-1 overlapping the straight line 30*a*-1 on a single straight line, an orifice 13*a*-1 is rotated in a direction in which the orifice 13*a*-1 approaches the straight line 30*a*-1 or is rotated beyond the straight line 30*a*-1 toward the X1-axis side. Specifically, the swirl fuel injection passage 10A1 is disposed such that, instead of the centerline 14*a*-1 of the swirl chamber introduction passage 11*a*-1 overlapping the straight line 30*a*-1 on a single straight line, the orifice 13*a*-1 is rotated about the intersection point 40*a*-1 in the direction in which the orifice 13*a*-1 approaches the X1-axis.

As with the swirl fuel injection passage 10A1, the swirl fuel injection passage 10A2 is disposed such that the centerline 14*b*-1 is rotated through a predetermined angle in the clockwise direction with respect to the straight line 30*b*-1. The swirl fuel injection passage 10A2 has a configuration similar to a configuration of the swirl fuel injection passage 10A1.

In the present embodiment, the swirl fuel injection passages 10 other than the swirl fuel injection passages 10A1 and 10A2 each have a configuration similar to the configuration of the swirl fuel injection passages 10A1 and 10A2. In this case, the swirl fuel injection passages 10 may be rotated through angles different from each other. Alternatively, at least one of all of the swirl fuel injection passages 10 may have the configuration similar to the configuration of the present embodiment.

Through the foregoing configuration, in the swirl fuel injection passage 10A1, fuel introduced from a fuel introduction port 28 flows in a direction from the center O1 of the nozzle plate 6 toward the outside in the radial direction. Thus, in the swirl chamber introduction passage 11, a flow F1 that flows directly in the orifice 13*a* is strong, while a flow F2 is weak. Similarly, in the swirl fuel injection passage 10A2, the fuel introduced from the fuel introduction port 28 flows in a direction from the center O1 of the nozzle plate 6 toward the outside in the radial direction. Thus, in the swirl chamber introduction passage 11, a flow F1 that flows directly in the orifice 13*a* is strong, while a flow F2 is weak. Thus, in the foregoing configuration, a swirl flow F3 is weak and the flows F1 and F1 that flow directly in the orifice 13 are strong. Thus, because of the effect described with reference to the first embodiment involved, a great effect can be achieved to prevent a spray injected from the orifice 13 from spreading.

Figure 18:
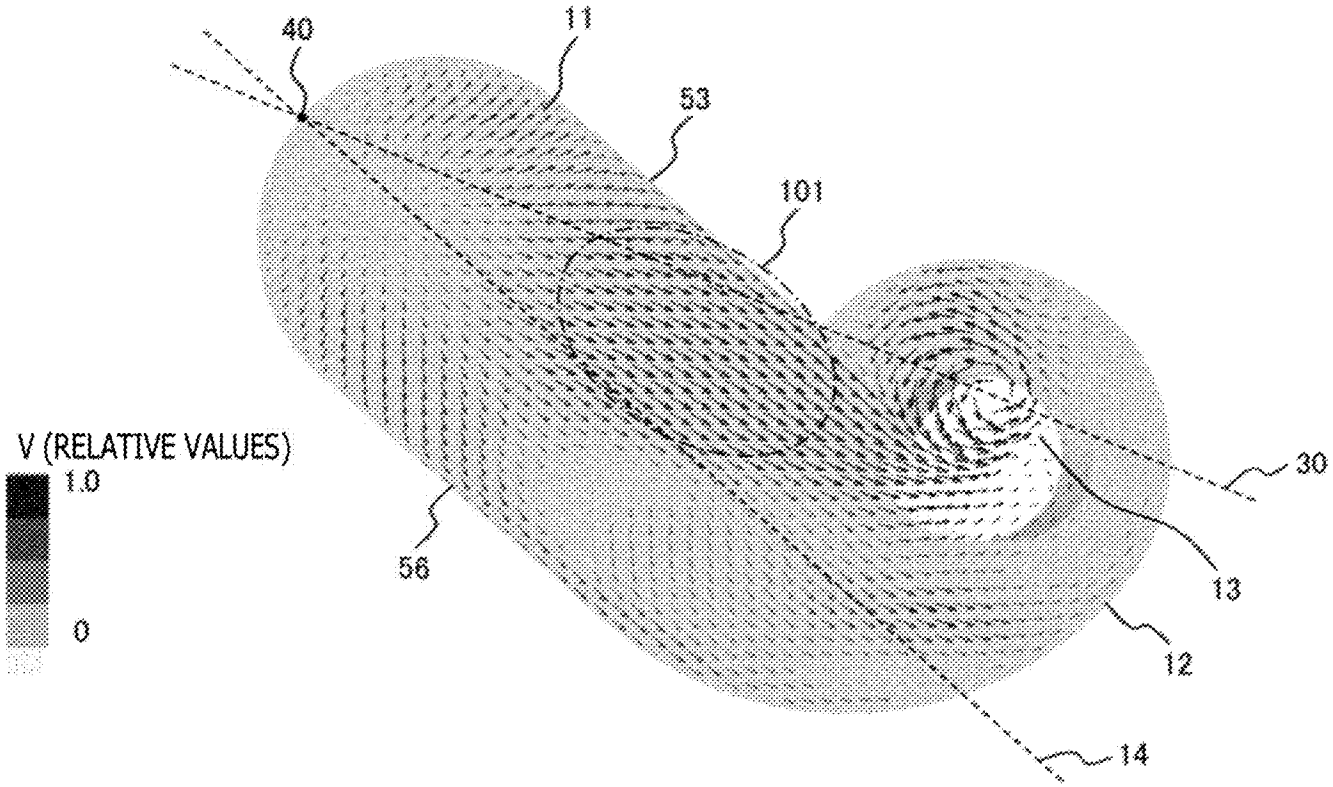
FIG. 18 is an illustrative view of results of a simulation of a fuel flow condition in the swirl fuel injection passage 10 disposed at a rotation angle similar to the rotation angle of the swirl fuel injection passage 10 shown in FIG. 17.

FIG. 18 is an illustrative view of results of a simulation of a fuel flow condition in the swirl fuel injection passage 10 disposed at a rotation angle similar to the rotation angle of the swirl fuel injection passage 10 shown in FIG. 17. In FIG. 18, the arrows indicating the fuel flow represent velocities (relative values).

In FIG. 18, the swirl fuel injection passage 10 is rotated in the X1-axis direction with respect to a straight line 30 (e.g., straight line 30*a*-1) that connects between the center O1 of the nozzle plate 6 and an intersection point 40 (e.g., intersection point 40*a*-1) between the swirl chamber introduction passage 11 and a centerline 14 (e.g., centerline 14*a*-1).

Figure 19:
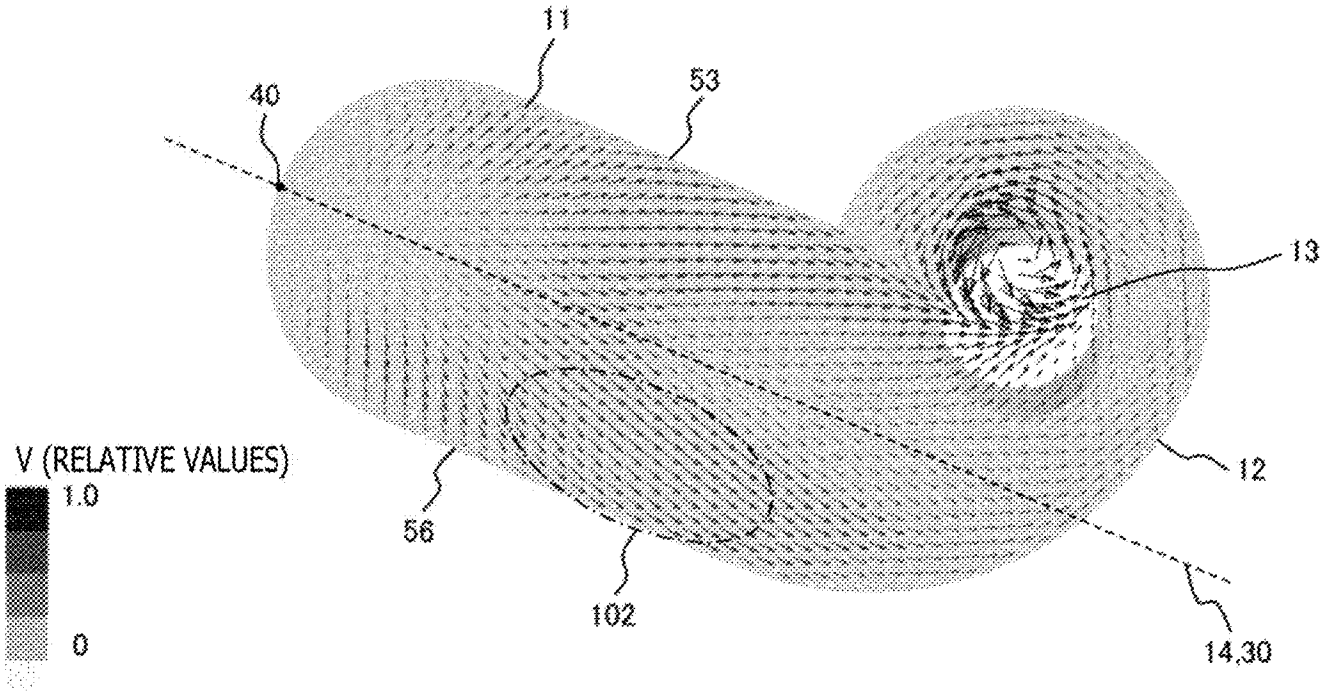
FIG. 19 is an illustrative view of results of a simulation of a fuel flow condition in the swirl fuel injection passage 10 in which a centerline 14 of a swirl chamber introduction passage 11 overlaps a straight line 30 on a single straight line.

FIG. 19 is an illustrative view of results of a simulation of a fuel flow condition in the swirl fuel injection passage 10 in which the centerline 14 of the swirl chamber introduction passage 11 overlaps the straight line 30 on a single straight line. In FIG. 19, the arrows indicating the fuel flow represent velocities (relative values).

The swirl fuel injection passage 10 shown in FIG. 19 is disposed similarly to the first embodiment.

In the configuration in which the swirl fuel injection passage 10 is disposed to be rotated in the X1-axis direction as shown in FIG. 18, fuel that flows on the side of a side surface 53 with respect to the centerline 14 (region denoted by reference numeral 101) increases in volume. The fuel flow on the side of the side surface 53 with respect to the centerline 14 assumes the fuel flow F1 that directly flows in the orifice 13. Meanwhile, fuel that flows on the side of a side surface 56 with respect to the centerline 14 is smaller in volume than the fuel that flows on the side of the side surface 53 with respect to the centerline 14. As a result, the flow F2 that forms the swirl flow F3 is smaller in volume.

With the swirl fuel injection passage 10 shown in FIG. 19, the fuel that flows on the side of the side surface 56 with respect to the centerline 14 (region denoted by reference numeral 102) increases in volume, compared with the swirl fuel injection passage 10 shown in FIG. 18. The fuel that flows on the side of the side surface 56 with respect to the centerline 14 forms the swirl flow F3, so that the swirl flow F3 increases in volume. Meanwhile, the fuel flow F1 that flows on the side of the side surface 53 with respect to the centerline 14 and that flows directly in the orifice 13 decreases in volume, as compared with the swirl fuel injection passage 10 shown in FIG. 18.

From the foregoing, the swirl fuel injection passage 10 is preferably disposed to be rotated in the X1-axis direction in order to enhance the effect of preventing sprays from spreading.

Figure 20:
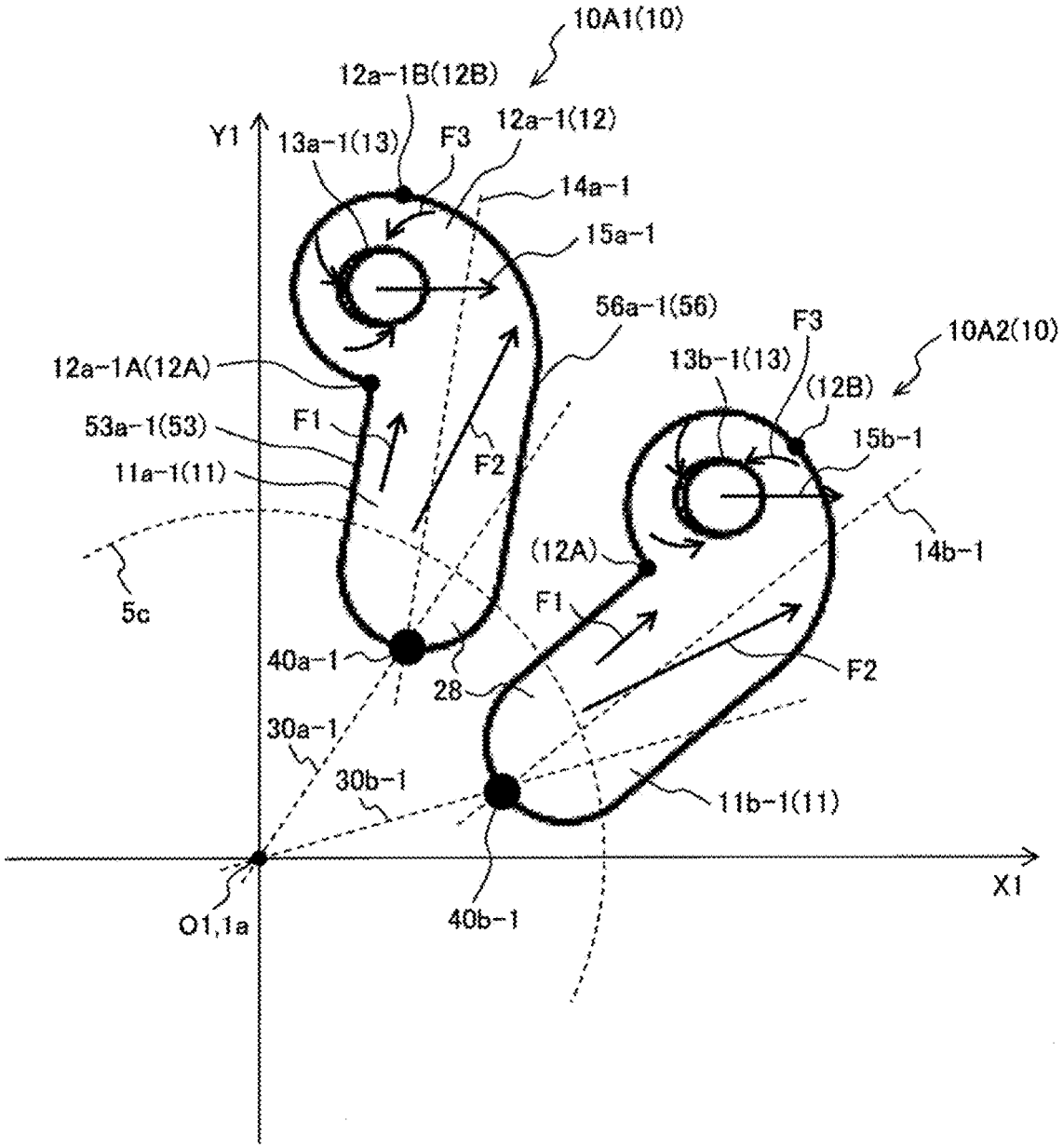
FIG. 20 shows a swirl fuel injection passage 10 in a fuel injection valve 1 according to a variation of the fifth embodiment of the present invention shown in FIG. 17, as viewed from a valve element side (proximal end side).

FIG. 20 shows a swirl fuel injection passage 10 in a fuel injection valve 1 according to a variation of the fifth embodiment of the present invention shown in FIG. 17, as viewed from a valve element side (proximal end side).

In a swirl fuel injection passage 10A1 in the present variation, a centerline 14*a*-1 is rotated through a predetermined angle in a counterclockwise direction (Y1-axis direction) about an intersection point 40*a*-1 with respect to a straight line 30*a*-1.

Specifically, in the swirl fuel injection passage 10A1, with respect to a condition in which the centerline 14*a*-1 of a swirl chamber introduction passage 11*a*-1 overlaps the straight line 30*a*-1 on a single straight line, a side surface 53*a*-1 (53) in a fuel flow direction has a downstream side portion rotated in a direction (Y1-axis direction) in which the downstream side portion is spaced away from the straight line 30*a*-1. To state the foregoing differently, the swirl fuel injection passage 10A1 is disposed such that, with respect to the condition in which the centerline 14*a*-1 of the swirl chamber introduction passage 11*a*-1 overlaps the straight line 30*a*-1 on a single straight line, a side surface 56*a*-1 (56) in the fuel flow direction has a downstream side portion rotated in a direction (Y1-axis direction) in which the downstream side portion approaches or crosses the straight line 30*a*-1. Or, the swirl fuel injection passage 10A1 is disposed such that, with respect to the condition in which the centerline 14*a*-1 of the swirl chamber introduction passage 11*a*-1 overlaps the straight line 30*a*-1 on a single straight line, the straight line 30*a*-1 is rotated in a direction in which the straight line 30*a*-1 is spaced away from an orifice 13*a*-1.

As with the swirl fuel injection passage 10A1, a swirl fuel injection passage 10A2 is disposed such that a centerline 14*b*-1 is rotated through a predetermined angle in the counterclockwise direction (Y1-axis direction) with respect to a straight line 30*b*-1. In this case, the angle through which different swirl fuel injection passages 10 are rotated may differ among the swirl fuel injection passages 10. The swirl fuel injection passage 10A2 has a configuration similar to a configuration of the swirl fuel injection passage 10A1.

In the present variation, the swirl fuel injection passages 10 other than the swirl fuel injection passages 10A1 and 10A2 each have a configuration similar to the configuration of the swirl fuel injection passages 10A1 and 10A2. In this case, the swirl fuel injection passages 10 may be rotated through angles different from each other. Alternatively, at least one of all of the swirl fuel injection passages 10 may have the configuration similar to the configuration of the present variation.

Still alternatively, the swirl fuel injection passages 10 may be disposed in a nozzle plate 6 such that the swirl fuel injection passage 10 in the fifth embodiment is mixed with the swirl fuel injection passage 10 in the present variation.

Through the foregoing configuration, fuel introduced from a fuel introduction port 28 flows in a direction from a center O1 of the nozzle plate 6 toward the outside in the radial direction. Thus, in a swirl chamber introduction passage 11, a flow F2 that is different from a flow F1 that flows directly in an orifice 13 is induced and a ratio of the flow F1 that flows directly in the orifice 13 is reduced. Specifically, as compared with the configuration shown in FIG. 17, the flow F2 is stronger and the flow F1 is weaker.

The flow F2 induces a swirl flow F3 through a swirl chamber 12 and the swirl flow F3 flows in the orifice 13. This results in, out of the fuel flowing in the orifice 13, the ratio of the flow F1 that flows directly in the orifice 13 decreasing and the ratio of the swirl flow F3 increasing. Thus, in the present configuration, a swirl effect by the swirl flow F3 promotes atomization in an area below the orifice 13. Thus, the spray spreads more widely compared with the configuration of FIG. 17.

As such, the arrangement of the swirl chamber introduction passage 11, the swirl chamber 12, and the orifice 13 being disposed to be rotated through a predetermined angle with respect to the center O1 of the nozzle plate 6 allows the fuel flow flowing through the swirl chamber introduction passage 11 to be varied. Thus, any desired spray can be formed by adjusting the angle of rotation according to the need for atomization and prevention of spray spreading.

Sixth Embodiment

Figure 21:
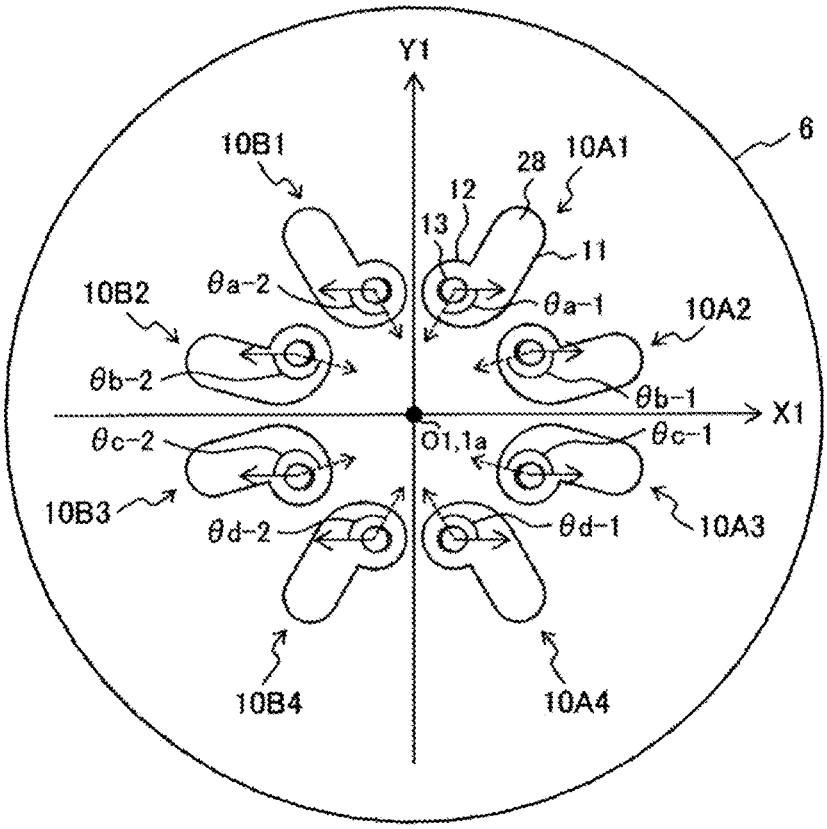
FIG. 21 shows a nozzle plate 6 in a fuel injection valve 1 according to a sixth embodiment of the present invention, as viewed from a valve element side (proximal end side).

FIG. 21 shows a nozzle plate 6 in a fuel injection valve 1 according to a sixth embodiment of the present invention, as viewed from a valve element side (proximal end side).

The swirl fuel injection passages 10 in each of the embodiments described above are configured such that the fuel flows substantially radially from the side of the center O1 of the nozzle plate 6 toward the outer peripheral side. In contrast, a swirl fuel injection passage 10 in the present embodiment is configured such that the fuel flows substantially radially from an outer peripheral side of the nozzle plate 6 toward the side of a center O1.

Thus, a swirl chamber 12 and an orifice 13 are disposed on the side of the center O1 of the nozzle plate 6 with respect to a fuel introduction port 28 and a swirl chamber introduction passage 11 is disposed to extend substantially radially across the swirl chamber 12 and the fuel introduction port 28.

In the present embodiment, too, the inclination angle θ of the orifice 13 in each of the swirl fuel injection passages 10 is set as follows:

$0° < \theta a\text{-}1 < 180°$
$0° < \theta b\text{-}1 < 180°$
$0° < \theta c\text{-}1 < 180°$
$0° < \theta d\text{-}1 < 180°$
$0° < \theta a\text{-}2 < 180°$
$0° < \theta b\text{-}2 < 180°$
$0° < \theta c\text{-}2 < 180°$
$0° < \theta d\text{-}2 < 180°$ The present embodiment may be configured similarly to the above-described embodiments in other respects. The configuration of each of the above-described embodiments may even be combined with the present embodiment.

The present embodiment is configured such that the orifices 13 are disposed near the center O1 of the nozzle plate 6 and fuel flows from the outer peripheral side of the nozzle plate 6 in the orifices 13 disposed on the side adjacent to the center O1 of the nozzle plate 6. The distance between the orifices is small in such a configuration. This unfortunately involves interference between sprays injected from adjacent orifices 13 in an area immediately below the orifices 13. The present embodiment can, however, prevent the spray from spreading and achieve the effect of preventing interference between sprays. This permits the arrangement of the orifices 13 as in the present embodiment.

In accordance with each of the embodiments and variations described above, a collision force of fuel on the inner wall surface of the orifice 13 can be increased and a swirling force can be utilized. The collision force and the swirling force can act to promote atomization. In addition, the spray can be prevented from spreading by adjusting the strength of the swirling force, so that the fuel injection valve 1 capable of forming atomized sprays oriented in two directions from a single nozzle plate 6 can be provided.

The nozzle plate 6 has an end face that is perpendicular to the central axis 1*a*. FIGS. 3 to 5, 10, and 13 to 21 each represent a projection drawing (plan view) of components projected onto the end face of the nozzle plate 6 or an imaginary plane perpendicular to the central axis 1*a*.

It should be noted that the present invention is not limited to the above-described embodiments and may include various modifications. For example, the entire detailed configuration of the embodiments described above for ease of understanding of the present invention is not always necessary to embody the present invention. Part of the configuration of one embodiment may be replaced with the configuration of another embodiment, or the configuration of one embodiment may be combined with the configuration of another embodiment. The configuration of each embodiment may additionally include another configuration, or part of the configuration may be deleted or replaced with another.

DESCRIPTION OF REFERENCE CHARACTERS

1: Fuel injection valve
2: Casing
2*a*: Fuel supply port
3: Valve element
4: Anchor
5: Nozzle body
6: Nozzle plate
10: Swirl fuel injection passage
11: Swirl chamber introduction passage
12: Swirl chamber
13: Orifice
14: Centerline of swirl chamber introduction passage
15: Inclination direction of orifice
16: yoke
F1: Flow of fuel flowing directly in orifice
F2: Subsidiary fuel flow
F3: Swirl flow
20: Filter
21: O-ring
22: Resin cover
23: Connector
24: Protector
25: O-ring
28: Fuel introduction port
31, 32: Spray
51: Orifice inlet cross section (inlet opening surface)
52: Orifice outlet cross section (outlet opening surface)
53: Side surface of swirl chamber introduction passage
56: Side surface of swirl chamber introduction passage
55: Extension from one end of swirl passage

The invention claimed is:

1. A fuel injection valve comprising:
a valve seat;
a valve element that cooperates with the valve seat to open or close a fuel passage; and
a plurality of swirl fuel injection passages, disposed on a downstream side of the valve seat, for imparting a swirling force to fuel to thereby inject the fuel outside, each of the swirl fuel injection passages including:
a swirl chamber that imparts a swirling force to fuel;
a swirl chamber introduction passage that introduces fuel to the swirl chamber; and
an orifice, disposed in the swirl chamber, for injecting fuel outside, wherein, when a rectangular coordinate system is imagined on an imaginary plane that extends perpendicularly to a central axis of the fuel injection valve and onto which the swirl fuel injection passage is projected, the rectangular coordinate system having a center of an inlet opening surface of the orifice as an origin and having an X-axis extending in parallel with a centerline of the swirl chamber introduction passage and being positive in a direction from an upstream side toward a downstream side of the swirl chamber introduction passage and a Y-axis extending perpendicularly to the X-axis and being positive in a direction away from the centerline, when the positive direction of the X-axis is defined as 0° and an angular direction of rotation from an angular position of 0° toward the centerline of the swirl chamber introduction passage is defined as a positive angular direction, the orifice has an inclination direction set to fall within a range from 0° to at least 180°, both exclusive, the inclination direction being defined by a projection straight line representing a straight line that extends from the center of the inlet opening surface toward a center of an outlet opening surface of the orifice and that is projected onto the imaginary plane, a part of the inlet opening surface of the orifice is formed in the swirl chamber introduction passage, and the plurality of swirl fuel injection passages are divided into a first swirl fuel injection passage group that forms a first spray and a second swirl fuel injection passage group that forms a second spray that is oriented in a direction different from a first direction.

2. The fuel injection valve according to claim 1, wherein the plurality of swirl fuel injection passages are divided into a first swirl fuel injection passage group that forms a first spray and a second swirl fuel injection passage group that forms a second spray that is oriented in a direction different from a first direction.

3. The fuel injection valve according to claim 2, wherein the swirl fuel injection passages constituting the first swirl fuel injection passage group and the swirl fuel injection passages constituting the second swirl fuel injection passage group are formed to be symmetrical with respect to a first plane that includes the central axis.

4. The fuel injection valve according to claim 3, wherein the swirl fuel injection passages are formed in a nozzle plate having an end face orthogonal to the central axis, the swirl chamber introduction passage has a side on an upstream end disposed on a side of a center of the nozzle plate with respect to a side on a downstream end, and the swirl chamber is connected with the side of the downstream end of the swirl chamber introduction passage and disposed on a side of an outer periphery of the nozzle plate with respect to the upstream end of the swirl chamber introduction passage.

5. The fuel injection valve according to claim 4, wherein the first swirl fuel injection passage group and the second swirl fuel injection passage group each include a second plurality of swirl fuel injection passages, the swirl fuel injection passages constituting the first swirl fuel injection passage group are formed to be symmetrical with respect to a second plane that includes the central axis and that is orthogonal to the first plane, and the swirl fuel injection passages constituting the second swirl fuel injection passage group are formed to be symmetrical with respect to the second plane.

6. The fuel injection valve according to claim 5, wherein, when a straight line that represents the first plane projected onto the imaginary plane is denoted as a Y1-axis and a straight line that represents the second plane projected onto the imaginary plane is denoted as an X1-axis, the swirl fuel injection passages constituting the first swirl fuel injection passage group and the second swirl fuel injection passage group are disposed to be rotated about an intersection point at which the centerline crosses a side surface of the swirl chamber introduction passage such that, with respect to a condition in which a linear imaginary line segment that passes through the intersection point and a center of the nozzle plate overlaps the centerline on a single straight line, the orifice approaches the X1-axis.

7. The fuel injection valve according to claim 6, wherein, in at least one out of the swirl fuel injection passages, the orifice has an inclination angle set to an angular range of 0° or 180° or greater.

* * * * *